US008548359B2

(12) United States Patent
Taniguchi et al.

(10) Patent No.: US 8,548,359 B2
(45) Date of Patent: Oct. 1, 2013

(54) CHARGING MEMBER, PROCESS CARTRIDGE AND ELECTROPHOTOGRAPHIC APPARATUS

(75) Inventors: Tomohito Taniguchi, Suntou-gun (JP); Masataka Kodama, Mishima (JP); Takehiko Aoyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/555,040

(22) Filed: Jul. 20, 2012

(65) Prior Publication Data

US 2012/0288301 A1 Nov. 15, 2012

Related U.S. Application Data

(63) Continuation of application No. PCT/JP2012/001569, filed on Mar. 7, 2012.

(30) Foreign Application Priority Data

Mar. 9, 2011 (JP) ..... 2011-051938

(51) Int. Cl.
*G03G 15/02* (2006.01)

(52) U.S. Cl.
USPC ..... 399/176

(58) Field of Classification Search
USPC ..... 399/174, 176, 168
See application file for complete search history.

(56) References Cited

U.S. PATENT DOCUMENTS

| | | | | |
|---|---|---|---|---|
| 7,381,510 | B2 | 6/2008 | Akiyama et al. | |
| 2006/0204280 | A1* | 9/2006 | Abe et al. | 399/176 |
| 2012/0141162 | A1 | 6/2012 | Mayuzumi et al. | |
| 2012/0177402 | A1 | 7/2012 | Taniguchi et al. | |

FOREIGN PATENT DOCUMENTS

| | | | |
|---|---|---|---|
| JP | 2000-275930 A | | 10/2000 |
| JP | 2002-250336 A | | 9/2002 |
| JP | 2004077972 A | * | 3/2004 |
| JP | 2004-279578 A | | 10/2004 |
| JP | 2009-86439 A | | 4/2009 |
| JP | 2012189706 A | * | 10/2012 |

OTHER PUBLICATIONS

Tomomizu, et al., U.S. Appl. No. 13/568,913, filed Aug. 7, 2012.
Suzumura, et al., U.S. Appl. No. 13/615,369, filed Sep. 13, 2012.
Kodama, et al., U.S. Appl. No. 13/615,403, filed Sep. 13, 2012.
Masu, et al., U.S. Appl. No. 13/649,928, filed Oct. 11, 2012.
Kuroda, et al., U.S. Appl. No. 13/615,380, filed Sep. 13, 2012. PCT International Search Report dated Jun. 12, 2012 in International Application No. PCT/JP2012/001569.
Yamada, "Learned Person from Today Series, Thoroughly Plain Book on Vibration & Noise", The First Edition, The Nikkan Kogyo Simbun, Ltd., Mar. 25, 2007, pp. 24-25.
Tohara, et al., "Rubber Vibration Insulators, New Edition", The Japan Association of Rolling Stock Industries, Oct. 30, 1998, pp. 97-99.

* cited by examiner

*Primary Examiner* — Susan Lee
(74) *Attorney, Agent, or Firm* — Fitzpatrick, Cella, Harper and Scinto

(57) ABSTRACT

A charging member is provided which can not easily cause vibration and can stably charge a photosensitive member, even where a high-frequency alternating-current voltage is applied thereto. It is a charging member having an electrically conductive substrate, an electrically conductive elastic layer and a surface layer, and the elastic layer has, in the order from the substrate side, a first rubber layer and a second rubber layer laminated to the first rubber layer, and, where the natural vibration frequency of the first rubber layer is represented by $f_1$ and the natural vibration frequency of the second rubber layer is represented by $f_2$, has a natural vibration frequency ratio, $f_2/f_1$, of from 2.35 or more to 10.0 or less.

9 Claims, 5 Drawing Sheets

CHARGING MEMBER, PROCESS CARTRIDGE AND ELECTROPHOTOGRAPHIC APPARATUS

CROSS-REFERENCE TO RELATED APPLICATIONS

This application is a continuation of International Application No. PCT/JP2012/001569, filed Mar. 7, 2012, which claims the benefit of Japanese Patent Application No. 2011-051938, filed Mar. 9, 2011.

BACKGROUND OF THE INVENTION

1. Technical Field

This invention relates to a charging member, and a process cartridge and an electrophotographic apparatus which make use of the same.

2. Background Art

In electrophotographic apparatus, in order to stably charge a drum-shaped electrophotographic photosensitive member (hereinafter simply "photosensitive member") electrostatically, it is common to apply to a charging member disposed in contact with the electrophotographic photosensitive member an alternating-current voltage in the state it is superimposed on a direct-current voltage. As one of problems in such a charging system, vibration noise is given which is caused by the resonance that exists between the photosensitive member and the charging member.

To cope with such a problem, a method is proposed in which a charging member having a natural vibration frequency at which no resonance may arise due to the frequency of the alternating-current voltage to be applied is used so as to prevent the vibration noise from being caused, as disclosed in Japanese Patent Application Laid-open No. 2004-279578. Now, in recent years, with demand for electrophotographic apparatus to be made higher in image quality and higher in process speed, it has come to be that an alternating-current voltage with a high frequency of, e.g., about 3,000 Hz is applied to the charging member.

The photosensitive member is also rotated at a high speed, with which rotation a motor itself that drives the photosensitive member vibrates and also gears and so forth that transmit the driving force of that motor vibrates. Such vibrations not only cause charging noise, but also vibrate the charging member disposed in contact with the photosensitive member, to make it difficult for the photosensitive member to be stably charged to a stated potential, and, as the result, lower the grade of electrophotographic images in some cases. Under such circumstances, the present inventors have come to the realization that development must be made on techniques which are to more surely reduce the vibration of the charging member.

SUMMARY OF THE INVENTION

Technical Problem

Accordingly, the present invention is directed to providing a charging member that can not easily cause vibration and can stably charge the photosensitive member electrostatically, even where a high-frequency alternating-current voltage is applied thereto.

The present invention is also directed to providing a process cartridge, and a photosensitive member, that can stably form high-grade electrophotographic images.

Solution to Problem

According to one aspect of the present invention, there is provided a charging member having an electrically conductive substrate, an electrically conductive elastic layer and a surface layer; the elastic layer having, in the order from the substrate side, a first rubber layer and a second rubber layer laminated to the first rubber layer, and, where the natural vibration frequency of the first rubber layer is represented by $f_1$ and the natural vibration frequency of the second rubber layer is represented by $f_2$, having a natural vibration frequency ratio, $f_2/f_1$, of from 2.35 or more to 10.0 or less.

According to another aspect of the present invention, there is provided a process cartridge which has the above charging member and a photosensitive member, integrally joined, and which is so set up as to be detachably mountable to the main body of an electrophotographic apparatus.

According to still another aspect of the present invention, there is provided an electrophotographic apparatus which has the above charging member and a photosensitive member.

Advantageous Effects of Invention

According to the present invention, a charging member can be obtained which can not easily cause vibration and can stably charge the photosensitive member electrostatically, even where a high-frequency alternating-current voltage is applied thereto.

According to the present invention, a process cartridge can also be obtained which contributes to the formation of high-grade electrophotographic images. According to the present invention, an electrophotographic apparatus can further be obtained which can form high-grade electrophotographic images.

DESCRIPTION OF THE EMBODIMENTS

The present inventors have made studies on techniques concerned with absorption of various vibrations, in order to make the charging member hold a vibration absorptive ability to cope with the above problem.

"Learned Person from Today Series, Thoroughly Plain Book on Vibration & Noise" by Shinji Yamada, The First Edition, The Nikkan Kogyo Simbun, Ltd., Mar. 25, 2007 presents on its page 25 a graph showing the relationship between vibration transmissibility and vibration frequency ratio (forced-vibration frequency/natural vibration frequency). Then, it is seen from this graph that the vibration comes maximal due to resonance when the vibration frequency ratio is 1 and that the vibration transmissibility decreases gradually when the vibration frequency ratio is $\sqrt{2}$ or more. It is also shown in this graph that the vibration transmissibility comes 0.5 or less when the vibration frequency ratio is approximately 2.4 to 3 and such a region of the vibration frequency ratio is a region of vibration insulation. Also, in "Rubber Vibration Insulators, New Edition" by Haruhiko Tohara and 10 other joint authors, new edition, The Japan Association of Rolling Stock Industries, Oct. 30, 1998, page 97, FIG. 7.2, a graph is presented which purports substantially the same as the graph shown in the above "Learned Person from Today Series, Thoroughly Plain Book on Vibration & Noise", page 25.

As can be seen from "Learned Person from Today Series, Thoroughly Plain Book on Vibration & Noise" by Shinji Yamada, The First Edition, The Nikkan Kogyo Simbun, Ltd., Mar. 25, 2007, pp. 24-25 and "Rubber Vibration Insulators, New Edition" by Haruhiko Tohara and 10 other joint authors, new edition, The Japan Association of Rolling Stock Industries, Oct. 30, 1998, pp. 97-99, it is known that, in absorbing vibrations by using springs or the like, the vibration frequency ratio is required to be higher than at least $\sqrt{2}$, in particular, preferably be 3 or more.

Figure 1:
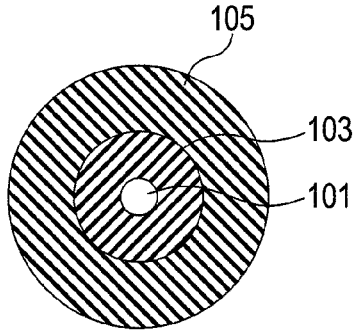
FIG. 1 is a side view showing an example of the charging member according to the present invention.

Accordingly, the present inventors have taken as a model a charging roller having, as shown in FIG. 1, a mandrel 101 and provided thereon a rubber layer consisting of a first rubber layer 103 and a second rubber layer 105. Then, they have regarded the second rubber layer 105 on the surface side of the charging roller as a vibration source, and the first rubber layer 103 on the mandrel 101 side as a rubber vibration insulator, and have made the first rubber layer 103 attenuate the vibration transmitted from the outside of the charging roller to the second rubber layer 105, to determine the vibration frequency ratio required for the first rubber layer 103 to keep the vibration from transmitting to the mandrel 101.

More specifically, in "Rubber Vibration Insulators, New Edition" by Haruhiko Tohara and 10 other joint authors, new edition, The Japan Association of Rolling Stock Industries, Oct. 30, 1998, page 98, as expression (7.6), the following equation (1) is presented which shows the relationship between i) vibration transmissibility and ii) vibration frequency ratio ($\omega/\omega_n$) and attenuation ratio ($C/C_c$).

$$\text{Transmissibility}=\frac{\sqrt{1+\left(2\frac{c}{c_c}*\frac{\omega}{\omega_n}\right)^2}}{\sqrt{\left(1-\frac{\omega^2}{\omega_n^2}\right)^2+\left(2\frac{c}{c_c}*\frac{\omega}{\omega_n}\right)^2}} \quad (1)$$

Accordingly, they have used the equation (1) to calculate the vibration frequency ratio at which the vibration transmissibility comes to 0.5. Here, they have substituted 0.5 for the attenuation ratio ($C/C_c$). The reason therefor is that rubber is chiefly used in the elastic layer of the charging member and the rubber usually shows an attenuation ratio of from 0.2 to 0.3. That is, as shown in the graphs of "Learned Person from Today Series, Thoroughly Plain Book on Vibration & Noise" by Shinji Yamada, The First Edition, The Nikkan Kogyo Simbun, Ltd., Mar. 25, 2007, pp. 24-25 and "Rubber Vibration Insulators, New Edition" by Haruhiko Tohara and 10 other joint authors, new edition, The Japan Association of Rolling Stock Industries, Oct. 30, 1998, pp. 97-99, in the region where the vibration frequency ratio is higher than $\sqrt{2}$, the vibration transmissibility becomes higher as the attenuation ratio is higher. Therefore, the value of vibration frequency ratio ($\omega/\omega_n$) that is found by substituting 0.5 for the term of attenuation ratio ($C/C_c$) in the equation (1) is considered to come to what makes the first rubber layer function sufficiently as the rubber vibration insulator in the relationship to the second rubber layer. As a result of the calculation, the natural vibration frequency the first rubber layer should have is 2.35 or more in relation to the natural vibration frequency of the second rubber layer.

Then, the present inventors have made studies on materials of the first rubber layer and second rubber layer so that the natural vibration frequency of the first rubber layer can be 2.35 or more in relation to the natural vibration frequency of the second rubber layer. As the result, they have discovered that respective rubber materials of the first rubber layer and second rubber layer and fillers to be incorporated in the rubber materials may be selected and this enables the natural vibration frequencies of the first rubber layer and second rubber layer to be so regulated as to satisfy the above relationship. The present invention is what has been accomplished on the basis of the results of such studies.

The charging member according to the present invention is described below in detail.

Figure 2:
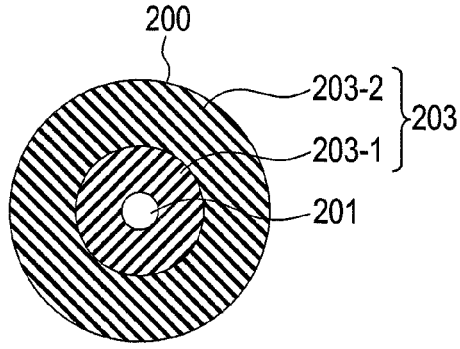
FIG. 2 is a side view showing another example of the charging member according to the present invention.

A charging member 200 according to the present invention has, as shown in FIG. 2, an electrically conductive mandrel 201 and an electrically conductive elastic layer 203. The elastic layer 203 has, in the order from the mandrel 201 side, a first rubber layer 203-1 and a second rubber layer 203-2 laminated to the first rubber layer 203-1. Then, the first rubber layer 203-1 has a natural vibration frequency thereof (hereinafter also "$f_1$") which is from 2.35 or more to 10.0 or less in relation to the natural vibration frequency of the second rubber layer 203-2 (hereinafter also "$f_2$").

Here, the technical significance in that the lower limit value of the natural vibration frequency ratio of the first rubber layer to the second rubber layer (hereinafter also "$f_2/f_1$") is set to be 2.35 is, as mentioned previously, to make the first rubber layer hold a superior function of vibration insulation so that the vibration applied to the charging member from the outside can be kept from transmitting to the mandrel.

The reason why on the other hand the upper limit value of the same is set to be 10.0 is that, as a result of experiments made by the present inventors, any material composition that can make the natural vibration frequency ratio higher than 10.0 has been unable to be found from among material composition endurable to practical service as any rubber layer of the charging member.

Mandrel

The electrically conductive mandrel 201 functions as an electrode for supplying to the elastic layer the power that imparts the desired electric charges to a charging object such as the photosensitive member, and also has the function to support the elastic layer 203 to be provided thereon. As a material therefor, it may include metals or alloys thereof, such as iron, copper, stainless steel, aluminum and nickel.

Elastic Layer

The elastic layer 203 has two layers which are in the order from the mandrel 201 side the first rubber layer 203-1 and the second rubber layer 203-2 provided in contact with the first rubber layer 203-1. Then, the natural vibration frequency ratio of the natural vibration frequency $f_2$ of the second rubber layer to the natural vibration frequency $f_1$ of the first rubber layer, $f_2/f_1$, is from 2.35 or more to 10.0 or less, and preferably from 3.0 or more to 8.0 or less.

Then, the natural vibration frequency $f_1$ of the first rubber layer and the natural vibration frequency $f_2$ of the second rubber layer may preferably respectively be within the following ranges of numerical values, presuming that they satisfy the above natural vibration frequency ratio.

$f_1$: From 100 Hz or more to 600 Hz or less, in particular, 150 Hz or more to 300 Hz or less.

$f_2$: From 400 Hz or more to 1,400 Hz or less, in particular, 500 Hz or more to 1,200 Hz or less.

As the above natural vibration frequencies each, a value may be employed which is found from the modulus of elasticity of the elastic layer by using the following equation (2) that determines the natural vibration frequency of a spring. In the equation (2), $f_0$ represents the natural vibration frequency of a spring one end of which is kept fastened; K, a spring constant (N/m); and M, the mass (kg) of a weight attached to the other end of the spring.

$$f_0 = \frac{1}{2\pi} \times \sqrt{\frac{K}{M}} \tag{2}$$

Taking note of a certain point of the elastic layer, M in the equation (2) may be replaced with mass per unit area. Accordingly, the natural vibration frequency of a rubber layer may be found from the following equation (3) as a value f calculated by substituting for K in the equation (2) the modulus of elasticity k of a rubber constituting the rubber layer, and for M therein the mass per unit area of the rubber layer, i.e., the product of layer thickness t and specific gravity a. Here, the unit of the layer thickness t is mm, the unit of the specific gravity a is g/cm$^3$ and the unit of the modulus of elasticity k is Pa.

$$f = \frac{1}{2\pi} \times \sqrt{\frac{k}{t * \sigma}} \tag{3}$$

In order to make the value of $f_2/f_1$ be from 2.35 or more to 10.0 or less, the layer thickness, specific gravity and modulus of elasticity of each rubber layer are controlled according to the equation (3). Stated specifically, about the second rubber layer, its modulus of elasticity is made higher than the modulus of elasticity of the first rubber layer, and the product of specific gravity and layer thickness is made smaller than that of the first rubber layer. This enables formation of the elastic layer that satisfies the natural vibration frequency ratio according to the present invention.

How to produce the first rubber layer and second rubber layer the value of, $f_2/f_1$ of which may satisfy the above range of numerical value is described next.

Selection of Rubbers

As rubbers that are chief constituent materials of the first rubber layer and second rubber layer, usable are natural rubbers or those subjecting them to vulcanization treatment, and elastomers such as synthetic rubbers. Stated specifically, the following may be exemplified. As the synthetic rubbers, usable are ethylene-propylene rubber, styrene-butadiene rubber (SBR), silicone rubbers, urethane rubber, isoprene rubber (IR), butyl rubber, acrylonitrile-butadiene rubber (NBR), chloroprene rubber (CR), acrylic rubber, epichlorohydrin rubber, fluorine rubber and so forth. Any of these may be used alone or in combination of two or more types.

Then, in order to regulate the value of $f_2/f_1$, it is preferable that the first rubber layer is incorporated with a rubber having a larger specific gravity than the second rubber layer. Rubber materials with which the first rubber layer and the second rubber layer may preferably be incorporated are given below.

First Rubber Layer

One or two or more rubber(s) selected from the group consisting of epichlorohydrin rubber, urethane rubber and fluorine rubber.

As specific examples of the epichlorohydrin rubber with which the first rubber layer may preferably be incorporated, it may include the following: An epichlorohydrin homopolymer, an epichlorohydrin-ethylene oxide copolymer, an epichlorohydrin-allylglycidyl ether copolymer and an epichlorohydrin-ethylene oxide-allylglycidyl ether terpolymer. Of these, the epichlorohydrin-ethylene oxide-allylglycidyl ether terpolymer is preferred because it exhibits stable electrical conductivity in the medium resistance region and can control electrical conductivity and workability by controlling its polymerization degree and compositional ratio as desired.

Second Rubber Layer

One or two or more rubbers selected from the group consisting of acrylonitrile-butadiene rubber, styrene-butadiene rubber, ethylene-propylene rubber and butadiene rubber.

Selection of Fillers

The specific gravity and modulus of elasticity of the elastic layer may be controlled by selecting the types and amounts of fillers with which the rubber layers are to be incorporated.

In general, the larger in content a filler is, the more its rubber reinforcement effect in a rubber layer is improved, and hence the rubber layer has a higher modulus of elasticity. The rubber layer also has a higher modulus of elasticity with use of what has a higher rubber reinforcement effect as the filler. On the other hand, the larger volume-average particle diameter the filler has, the lower modulus of elasticity the rubber layer has.

Accordingly, as specific methods by which the value of $f_2/f_1$ is regulated toward a larger value by using the filler, the following methods (1) to (3) are available.

(1) A method in which the content of the filler in the second rubber layer is set larger than the content of the filler in the first rubber layer; preferably, the first rubber layer is not incorporated with the filler and only the second rubber layer is incorporated with the filler.

Stated specifically, where, e.g., both the first rubber layer and the second rubber layer are incorporated as the filler with carbon black or, silica having equal volume-average particle diameter, a method is available in which the content of the filler in the second rubber layer is set 9- to 100-fold by mass based on the content of the filler in the first rubber layer.

The filler with which each rubber layer is to be incorporated may include particles of inorganic compounds and particles of organic compounds.

Specific examples of materials for the particles of inorganic compounds are given below: Zinc oxide, tin oxide, indium oxide, titanium oxide (such as titanium dioxide or titanium monoxide), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, dolomite, talc, kaolin clay, mica, aluminum hydroxide, magnesium hydroxide, zeolite, wollastonite, diatomaceous earth, glass beads, bentonite, montmorillonite, hollow glass balloons, organometallic compounds, organometallic salts, iron oxides such as ferrite, magnetite and hematite, and activated carbon.

Specific examples of materials constituting the particles of organic compounds are given below: Polyamide resins, silicone resins, fluorine resins, acrylic or methacrylic resins, styrene resins, phenol resins, polyester resins, melamine resins, urethane resins, olefin resins, epoxy resins, and copolymers, modified products or derivatives of these; ethylene-propylene-diene copolymer (EPDM), styrene-butadiene copolymer rubber (SBR), silicone rubbers, urethane rubbers, isoprene rubber (IR), butyl rubber, and chloroprene rubber (CR).

(2) A method in which, as the filler with which the second rubber layer is to be incorporated, a filler is used which has a higher rubber reinforcement effect than the filler with which the first rubber layer is to be incorporated.

In this case, the filler having a higher rubber reinforcement effect may include carbon black and silica which are detailed later. A filler having on the other hand a relatively lower rubber reinforcement effect than the carbon black and silica may include calcium carbonate, magnesium carbonate, zinc oxide, tin oxide and magnesium oxide.

(3) A method in which the volume-average particle diameter of the filler with which the second rubber layer is to be incorporated is set smaller than that of the filler with which the first rubber layer is to be incorporated.

Stated specifically, where carbon black is used as the filler in both the first rubber layer and the second rubber layer, the volume-average particle diameter of the filler with which the first rubber layer is to be incorporated is set to be from 100 nm to 900 nm and the volume-average particle diameter of the filler with which the second rubber layer is to be incorporated is set to be from 10 nm to 50 nm. This enables the first rubber layer and second rubber layer to have a significant relative difference in modulus of elasticity that comes from the filler.

Now, the addition of the filler to the elastic layer acts toward a higher modulus of elasticity for the elastic layer, as mentioned above. More specifically, if for the purpose of making the value of $f_2/f_1$ larger it is attempted to make the specific gravity of the first rubber layer larger than the specific gravity of the second rubber layer by incorporating the first rubber layer with the filler, the first rubber layer increases in its modulus of elasticity, and this may act disadvantageously for the achievement of the above purpose. Hence, the specific gravity of the first rubber layer may preferably be controlled chiefly by appropriately selecting the type of the rubber with which the first rubber layer is to be incorporated. It is much preferable, and ideal, that the first rubber layer is not incorporated with any filler.

Meanwhile, the specific gravity and modulus of elasticity of the second rubber layer may preferably be controlled by selecting the rubber materials, and selecting the type of the filler and controlling the amount of the same to be added.

Here, as the filler with which the second rubber layer is to be incorporated, a filler having a small specific gravity may be used, and this is preferable in order to make the value of $f_2/f_1$ larger. Any use of a filler having a large specific gravity may act toward a higher modulus of elasticity for the second rubber layer, but may inevitably act toward a smaller value of $f_2$. Accordingly, as the filler that controls the modulus of elasticity of the second rubber layer, it is preferable to use a filler having a small specific gravity.

As specific examples of such a filler, it may include carbon black and silica. These fillers are so highly effective in rubber reinforcement as to enable the elastic layer to have dramatically higher modulus of elasticity, and also, as having specific gravity in a value of as small as about 2, can control the $f_2$ toward a larger value.

The carbon black may be exemplified by furnace black, thermal black, acetylene black and KETJEN BLACK. The furnace black may be exemplified by the following: SAF-HS, SAF, ISAF-HS, ISAF, ISAF-LS, I-ISAF-HS, HAF-HS, HAF, HAF-LS, T-HS, T-NS, MAF, FEF, GPF, SRF-HS-HM, SRF-LM, ECF and FEF-HS. The thermal black may be exemplified by FT and MT.

As the silica, usable are dry-process silica produced by a gas phase process in which silicon tetrachloride is burnt with oxygen and hydrogen; wet-process silica obtained by finely pulverizing silica produced from sodium silicate and a mineral acid such as sulfuric acid; colloidal silica; and a synthetic silicate.

Thickness of Rubber Layer

In regard to the modulus of elasticity of the first rubber layer and that of the second rubber layer, the rubber layers may preferably respectively be within the ranges of numerical values as shown below, presuming that they satisfy the above relationship of $f_2/f_1$.

First rubber layer: From 3 MPa or more to 35 MPa or less, in particular, 3 MPa or more to 7 MPa or less.

Second rubber layer: From 8 MPa or more to 55 MPa or less, in particular, 14 MPa or more to 48 MPa or less.

Presuming that the modulus of elasticity of the first rubber layer and that of the second rubber layer are within the above ranges, the second rubber layer may further preferably be, as its specific thickness, in the range of from 200 μm or more to 1,500 μm or less, in particular, from 300 μm or more to 1,200 μm or less.

The thickness of the second rubber layer, having a relatively high modulus of elasticity, may be set within the above range, and this enables a nip to be formed in a large width between the charging member and the photosensitive member. Then, the first rubber layer may preferably have a thickness of from 0.75-fold or more to 14.3-fold or less, and much preferably from 1.00-fold or more to 6.67-fold or less, of the thickness of the second rubber layer.

In the first rubber layer and the second rubber layer, presuming that they satisfy the above relationship of $f_2/f_1$ and as long as the above rubber materials are not functionally inhibited, additives may be contained which are, e.g., a softening oil and a plasticizer which control rubber hardness, and besides an age resistor and a bulking agent which provide the rubber with various functions.

For example, the first rubber layer and the second rubber layer may each be incorporated with a conduction agent which provides them with electrical conductivity. As the conduction agent, either of an ionic conduction agent and an electronic conduction agent may be used. Here, in adding the electronic conduction agent, there is a possibility that it influences the natural vibration frequency of the elastic layer, and hence, in order to control the electrical conductivity, it is preferable to use the ionic conduction agent.

As the ionic conduction agent, a quaternary ammonium perchlorate is preferable because it promises a stable electrical resistance against environmental variations. In particular, where a polar rubber is used in a binder for the elastic layer, it is preferable to use such an ammonium salt.

Each rubber layer may preferably be, as its volume resistivity, from $10^2$ Ω·cm or more to $10^8$ Ω·cm or less in an environment of temperature 23° C. and humidity 50% RH. The volume resistivity of each rubber layer may be measured in the same way as a method of measuring the volume resistivity of a surface layer described later, using a volume resistivity measuring sample obtained by molding all materials for the elastic layer into a sheet of 1 mm in thickness and vacuum-depositing a metal on its both sides to form an electrode and a guard electrode.

The first rubber layer and the second rubber layer may each preferably be, as their hardness, 70° or less, and particularly preferably 60° or less, as microhardness (MD-1 type). This is because the nip width between the charging member and the photosensitive member can be secured and the charging member can stably be follow-up rotated with the rotation of the photosensitive member. As the microhardness (MD-1 microhardness), a value may be employed which is measured with a microhardness meter (trade name: MD-1 capa; manufactured by Kobunshi Keiki Co., Ltd.) in a 10 N peak hold mode after the charging member has been left to stand for 12 hours or more in an environment of normal temperature and normal humidity (temperature 23° C./humidity 55% RH).

As a method of forming the elastic layer according to the present invention, a method is available in which a material for the elastic layer obtained by kneading the binder rubber, the conduction agent, the filler and so forth is extruded or injection-molded. Stated specifically, a material for the first rubber layer and a material for the second rubber layer are prepared, and these materials are co-extruded around a substrate simultaneously and in an integral form, followed by vulcanization. A plurality of layers may be formed by such co-extrusion simultaneously and in an integral form, and this enables simplification of steps.

As another method, a method is available in which a roller obtained by molding an unvulcanized first rubber layer on a substrate is prepared, then separately a material for the second rubber layer is molded into an unvulcanized tube or sheet and then the roller having the molded unvulcanized first rubber layer is covered with this tube or sheet, followed by vulcanization in a mold.

As still another method, a method may further be exemplified in which a roller obtained by molding an unvulcanized first rubber layer on a substrate and vulcanizing the unvulcanized first rubber layer is produced, then separately a material for the second rubber layer is molded into an unvulcanized tube or sheet, which is then completed being vulcanized so far to form a tube-shaped second rubber layer, and thereafter the roller having the first rubber layer is inserted into the tube-shaped second rubber layer while air is flowed thereinto.

The elastic layer obtained may optionally be put to sanding or surface treatment. The sanding may be carried out by using an NC cylindrical grinder of a traverse system or an NC cylindrical grinder of a plunge cutting system, by which the roller may be made into a crown shape or the like. As the surface treatment, there may be given a treatment making use of UV rays or electron rays, and a surface modification treatment carried out by making a compound adhere to the surface or impregnating the latter with the former.

Surface Layer

The charging member according to the present invention may additionally be provided with a surface layer of approximately from 1 μm to 50 μm in thickness on the outside of the second rubber layer in order to keep any stains from adhering to the surface of the charging member.

The charging member according to the present invention may have an electrical resistance of from $1\times10^3$ Ω·cm or more to $1\times10^{10}$ Ω·cm or less in an environment of temperature 23° C. and humidity 50% RH. This is preferable because the photosensitive member can well be charged.

The charging member according to the present invention may also preferably have a ten-point average surface roughness Rzjis (μm) of $2\leq Rzjis\leq100$, and its surface may preferably have a hill-to-dale average distance Sm (μm) of $15\leq Sm\leq200$. How to measure the ten-point average surface roughness Rzjis and surface hill-to-dale average distance Sm is described below.

These are measured according to JIS B 0601-1994 surface roughness standard, and with a surface profile analyzer SE-3500 (trade name; manufactured by Kosaka Laboratory Ltd.). The Rzjis may be found as an average value of values found when it is measured at 6 spots picked up at random on the surface of the charging roller. Also, the Sm may be calculated as an average value of average values at 6 spots, found by measuring hill-to-dale distances at 10 points at each spot of 6 spots picked up at random on the surface of the charging roller to find their average values. Measurement conditions are as shown below.

Cut-off value: 0.8 mm.
Filter: Gaussian filter.
Standard length: Cut-off×2.
Leveling: Straight line (whole area).
Evaluation length: 8 mm.

Electrophotographic Apparatus

Figure 5:
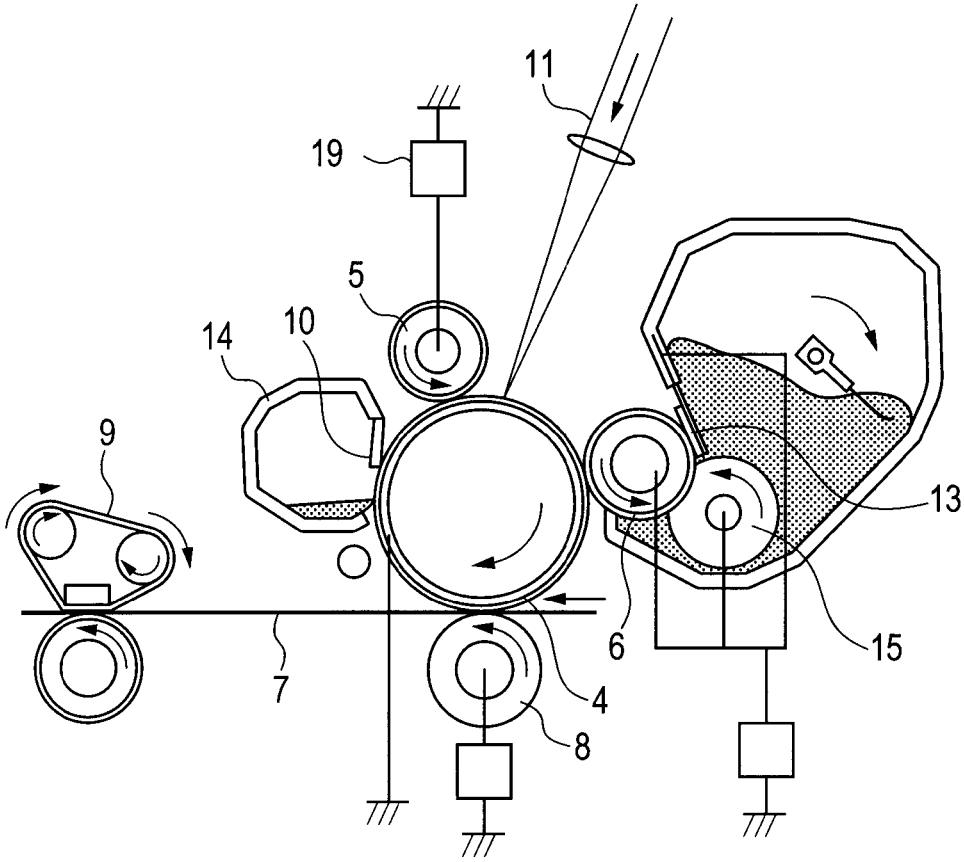
FIG. 5 is a schematic structural view showing an example of the electrophotographic apparatus according to the present invention.

The electrophotographic apparatus of the present invention may at least be one having the charging member and photosensitive member described above. An example of its construction is schematically shown in FIG. 5. It has a process cartridge in which an electrophotographic photosensitive member 4 (hereinafter also "photosensitive member") and a charging assembly having a charging roller 5 as the charging member described above are integrally joined, a latent image forming unit 11 which forms latent images on the photosensitive member, a developing assembly which makes the latent images into toner images, and a transfer assembly which transfers the toner images to a transfer material 7 such as a paper sheet. It is further constituted of a cleaning assembly which collects any toner remaining on the photosensitive member after transfer of the toner images, a fixing assembly 9 which fixes the toner images onto the transfer material, and so forth. The cleaning assembly is constituted of a cleaning blade 10 and a waste toner container 14.

The photosensitive member 4 is of a rotating drum type having a photosensitive layer on a conductive substrate, and is rotatingly driven at a stated peripheral speed (process speed) in the direction shown by an arrow. The charging roller 5 is kept at a stated voltage applied thereto from an alternating-current power source 19 and is follow-up rotated with the rotation of the photosensitive member provided in contact therewith at a stated pressing force to charge the photosensitive member electrostatically to a stated potential. In the latent image forming unit, the photosensitive member thus charged uniformly is exposed to light in accordance with image information by means of an exposure unit (not shown) such as a laser beam scanner which emits laser light 11, thus electrostatic latent images are formed on the photosensitive member.

To the electrostatic latent images formed on the photosensitive member, a toner having the same polarity as the photosensitive member is transferred by means of a developing sleeve or developing roller 6 which is provided in proximity to or in contact with the photosensitive member, and the electrostatic latent images are developed by reverse development to form the toner images thereon. The toner images formed on the photosensitive member are, in the transfer assembly, transferred therefrom to the transfer material 7 such as plain paper, which is transported by a paper feed system to the part between a transfer roller 8 and the photosensitive member. Thereafter, in the fixing assembly 9, the toner images held on the transfer material 7 are fixed to the transfer material 7 by means of a heat roller and so forth, which transfer material with fixed images is then delivered out of the machine to obtain images reproduced.

Meanwhile, the transfer residual toner remaining on the photosensitive member is, in the cleaning unit, mechanically scraped off by means of the blade type cleaning member 10 and collected in a collecting container. Here, a cleaning-at-development system which collects the transfer residual toner through the developing assembly may be employed so as to omit the cleaning unit.

Process Cartridge

Figure 6:
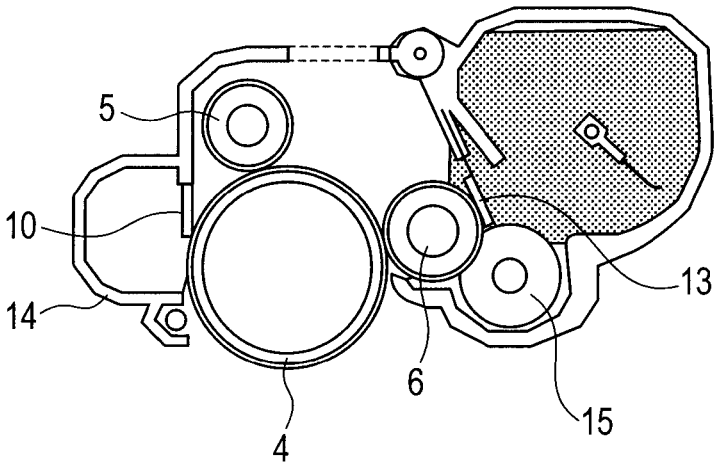
FIG. 6 is a schematic structural view showing an example of the process cartridge according to the present invention.

The process cartridge of the present invention may at least be one having the charging member and photosensitive member described above which are integrally joined and being so set up as to be detachably mountable to the main body of the electrophotographic apparatus. As an example thereof, a process cartridge may be given in which, as shown in FIG. 6, a photosensitive member 4, a charging assembly having a charging roller 5, a developing assembly having a developing roller 6, a toner feed roller 15 and a developing blade 13, a cleaning assembly constituted of a cleaning blade 10 and a waste toner container 14 are integrally joined, and which is so set up as to be detachably mountable to the main body of the electrophotographic apparatus.

EXAMPLES

The charging member of the present invention is specifically described below in detail by giving working examples.

Production Example 1

Making of Composite Conductive Fine Particles

To 7.0 kg of silica particles (number-average particle diameter: 15 nm; volume resistivity: $1.8\times10^{12}$ Ω·cm), 140 g of methylhydrogenpolysiloxane was added operating an edge runner mill. Then, these materials were mixed and agitated for 30 minutes at a linear load of 588 N/cm (60 kg/cm). Here, the agitation was carried out at a rate of 22 rpm. To what was thus agitated, 7.0 kg of carbon black particles (number-average particle diameter: 20 nm; volume resistivity: $1.0\times10^{2}$ Ω·cm; pH: 8.0) were added over a period of 10 minutes, operating the edge runner mill, and these materials were further mixed and agitated for 60 minutes at a linear load of 588 N/cm (60 kg/cm).

Thus, the carbon black was made to adhere to the surfaces of silica particles having been coated with methylhydrogenpolysiloxane, followed by drying at 80° C. for minutes by means of a dryer to obtain composite conductive fine particles. Here, the agitation was carried out at a rate of 22 rpm. The composite conductive fine particles obtained had a number-average particle diameter of 15 nm and a volume resistivity of $1.1\times10^{2}$ Ω·cm.

Production Example 2

Making of Surface-Treated Titanium Oxide Particles 1,000 g of acicular rutile type titanium oxide particles (number-average particle diameter: 15 nm; length/breadth=3:1; volume resistivity: $2.3\times10^{10}$ Ω·cm) was compounded with 110 g of isobutyltrimethoxysilane as a surface treating agent and 3,000 g of toluene as a solvent to prepare a slurry. This slurry was mixed for 30 minutes by means of a stirrer, and thereafter fed to Visco mill the effective internal volume of which was filled by 80% with glass beads of 0.8 mm in number-average particle diameter, to carry out wet-process disintergration treatment at a temperature of 35±5° C.

The slurry obtained by wet disintegration treatment was distilled under reduced pressure by using a kneader (bath temperature: 110° C.; product temperature: 30° C. to 60° C.; degree of reduced pressure: about 100 Torr) to remove the toluene, followed by baking of the surface treating agent at 120° C. for 2 hours. The particles having been treated by baking were cooled to room temperature, and thereafter pulverized by means of a pin mill to obtain surface-treated titanium oxide particles.

Example 1

Substrate

A substrate made of stainless steel and being 6 mm in diameter and 252.5 mm in length was coated with a thermosetting adhesive incorporated with 10% by mass of carbon black, followed by drying.

Material for First Rubber Layer

Materials shown in Table 1 below were kneaded for 10 minutes by means of a closed mixer temperature-controlled at 50° C., to obtain an unvulcanized rubber composition.

TABLE 1

| | |
|---|---|
| Epichlorohydrin rubber (EO-EP-AGE terpolymer; EO/EP/AGE = 73 mol %/23 mol %/4 mol %) | 100 parts by mass |
| Calcium carbonate | 60 parts by mass |
| Aliphatic polyester type plasticizer | 5 parts by mass |
| Zinc stearate | 1 part by mass |
| 2-Mercaptobenzimidazole (MB) (age resistor) | 0.5 part by mass |
| Zinc oxide | 5 parts by mass |
| Quaternary ammonium salt (trade name: ADECASIZER LV-70; available from Asahi Denka Kogyo K.K.) | 2 parts by mass |
| Carbon black (trade name: THERMAX FLOFORM N990; available from Cancab Technologies Ltd.; volume-average particle diameter: 270 nm) | 5 parts by mass |

Next, to 178.5 parts by mass of the above unvulcanized rubber composition, 1.2 parts by mass of sulfur as a vulcanizing agent and as vulcanization accelerators 1 part by mass of dibenzothiazyl sulfide (DM) and 1 part by mass of tetramethylthiuram monosulfide (TS) were added, and these were kneaded for 10 minutes by means of a twin-roll mill kept cooled to a temperature of 20° C., to obtain a material for first rubber layer.

Material for Second Rubber Layer

Materials shown in Table 2 below were kneaded for 15 minutes by means of a closed mixer temperature-controlled at 50° C., to obtain an unvulcanized rubber composition.

TABLE 2

| | |
|---|---|
| Acrylonitrile-butadiene rubber (NBR) (trade name: JSR230SV; available from JSR Corporation) | 100 parts by mass |
| Zinc stearate | 1 part by mass |
| Zinc oxide | 5 parts by mass |
| Calcium carbonate | 20 parts by mass |
| Carbon black (trade name: TOKA BLACK #7360SB; available from Tokai Carbon Co., Ltd.; volume-average particle diameter: 28 nm) | 48 parts by mass |

Next, to 174 parts by mass of the above unvulcanized rubber composition, materials shown in Table 3 below were added, and these were kneaded for 15 minutes by means of a twin-roll mill kept cooled to 20° C., to obtain a material for second rubber layer.

TABLE 3

| | |
|---|---|
| Vulcanizing agent: sulfur | 1.2 parts by mass |
| Vulcanization accelerator: tetrabenzylthiuram disulfide | 4.5 parts by mass |

Elastic Roller

Figure 7:
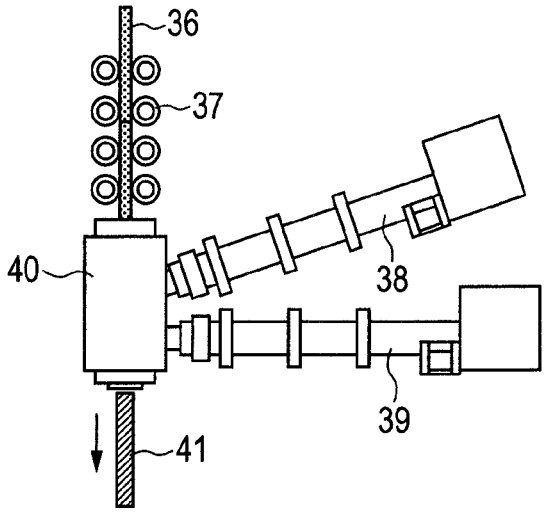
FIG. 7 is a schematic structural view showing an example of equipment for producing the charging member according to the present invention.

Using a cross-head extruder shown in FIG. 7, the material for first rubber layer and the material for second rubber layer were extruded together with the substrate in such a way as to be coaxially formed around the substrate in the order of the first rubber layer and the second rubber layer. Incidentally, in FIG. 7, reference numeral 36 denotes a mandrel serving as the substrate; 37, mandrel feed rollers; 40, a cross-head; 38 and 39, extruder screws which introduce rubber into the cross-head; and 41, a mandrel having been covered with the first rubber layer and the second rubber layer.

Thus, a roller was produced which had the substrate and laminated on its peripheral surface the first rubber layer and second rubber layer, which stood unvulcanized. The extrusion was so controlled that the roller was 12.5 mm in outer diameter. The numbers of revolutions of screw portions of the cross-head extruder were so controlled as for the first rubber layer to be 2.5 mm in layer thickness and for the second rubber layer to be 1 mm in layer thickness. Then, this was heated at a temperature of 160° C. for 1 hour in a hot-air oven, and thereafter both end portions of the rubber obtained were cut off to make the rubber be 224.2 mm in length. Further, this was ground on the peripheral surface of the second rubber layer by means of a cylindrical grinder of a plunge cutting system so as to be shaped into a roller of 12 mm in external diameter, to obtain an elastic layer. This roller was in a crown level (the difference in external diameter between that at the middle portion and that at positions 90 mm away from the middle portion) of 120 μm.

Surface Layer Coating Fluid

To a caprolactone modified acrylic polyol solution (trade name: PLACCEL DC2016; available from Daicel Chemical Industries, Ltd.), methyl isobutyl ketone was added to control the former's solid content so as to be 17% by mass. To 588.24 parts by mass of the solution obtained (100 parts by mass of the acrylic polyol solid content), materials shown in Table 4 below were added to prepare a mixture solution.

TABLE 4

| | |
|---|---|
| Composite conductive fine particles (made in Production Example 1) | 45 parts by mass |
| Surface-treated titanium oxide particles (made in Production Example 2) | 20 parts by mass |
| Modified dimethylsilicone oil (trade name: SH28PA; available from Dow Corning Toray Silicone Co., Ltd.) | 0.08 part by mass |
| Blocked isocyanate mixture * | 80.14 parts by mass |

*The blocked isocyanate mixture was a 7:3 mixture of hexamethylene diisocyanate (HDI) and isophorone diisocyanate (IPDI) each blocked with butanone oxime. Here, as the HDI, "DURANATE TPA-B80E" (trade name; available from Asahi Chemical Industry Co. Ltd.) was used and, as the IPDI, "BESTANATO B1370" (trade name; available from Degussa-Hulls AG) was used. Also, the blocked isocyanate mixture was in an amount given by "NCO/OH = 1.0".

195.6 g of the above mixture solution was put into a glass bottle of 450 ml in internal volume together with 200 g of glass beads of 0.8 mm in volume-average particle diameter as dispersion media, followed by dispersion for 28 hours by using a paint shaker dispersion machine. After the dispersion was completed, 2.55 g of polymethyl methacrylate resin particles (in an amount corresponding to 10 parts by mass based on 100 parts by mass of the acrylic polyol solid content) of 10 μm in volume-average particle diameter were added thereto. Thereafter, the dispersion was carried out for 5 minutes, and then the glass beads were removed to obtain a surface layer coating fluid.

Charging Roller

Using the surface layer coating fluid thus obtained, the elastic roller having been produced was coated therewith by dipping once. This dip coating was carried out in a dipping time of 9 seconds, where the rate of draw-up of dip-coating was 20 mm/s for initial-stage rate and 2 mm/s for end rate, during which the rate was changed linearly with respect to the time. Thereafter, the coating formed was air-dried at normal temperature for 30 minutes or more, and thereafter dried by means of a circulating hot-air drier at 80° C. for 1 hour and further at 160° C. for 1 hour to obtain a charging roller 1 having the elastic layer and a surface layer formed thereon.

About the charging roller 1, the modulus of elasticity, layer thickness and specific gravity of the first rubber layer and second rubber layer each were measured by the following methods. Results obtained are shown in Table 12. The results of measurement of these were also substituted for the equation (3) shown previously, to calculate the natural vibration frequency of the first rubber layer and second rubber layer each. The results are shown in Table 13.

Modulus of Elasticity

Figure 3A:
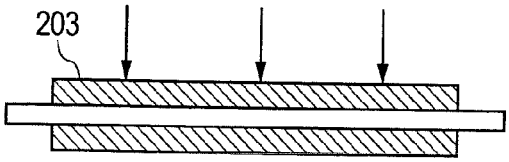
FIG. 3A illustrates how to measure the modulus of elasticity of the charging member according to the present invention.
Figure 3B:
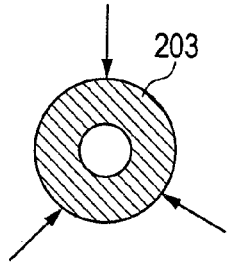
FIG. 3B illustrates how to measure the modulus of elasticity of the charging member according to the present invention.

The surface layer of the charging roller was ground by using the cylindrical grinder of a plunge cutting system to make the elastic layer laid bare to the surface, and the modulus of elasticity of each rubber layer was measured with a surface hardness measuring instrument (trade name: FISCHER SCOPE H100V; manufactured by Fischer Instruments K.K.). On this occasion, the measurement was made after the charging roller was left to stand for 12 hours or more in an environment of 23° C./50% RH. The positions of measurement were, about the axial direction of the charging member 200, set at 3 spots as shown in FIG. 3A, which were the middle portion of an elastic layer 203 in its axial direction and the middle points between the middle portion of the elastic layer in its axial direction and both end portions of the elastic layer in its axial direction, and, about the peripheral direction, at 3 spots at intervals of 120° as shown in FIG. 3B, i.e., at 9 spots in total.

As conditions for the measurement, a measuring indenter was indented to the surface under a load of 300 mN and at a rate of 1 μm/10 seconds. Also, the surface roughness of each rubber layer of the elastic layer laid bare to the surface was so controlled as to be 6 μm or less in ten-point average surface roughness Rzjis (μm) described previously.

Layer Thickness

Sections of the charging roller were cut out with any sharp cutlery at the respective positions at which the modulus of elasticity was measured, and were observed on an optical microscope or electron microscope to measure their radii, the layer thickness of the second rubber layer and the layer thickness Of the surface layer, where the layer thickness of the first rubber layer was found by subtracting from the radii the total layer thickness of the second rubber layer and surface layer. An average value for each layer was calculated at the positions of measurement on the 9 spots shown in FIGS. 3A and 3B.

Specific Gravity

Figure 8A:
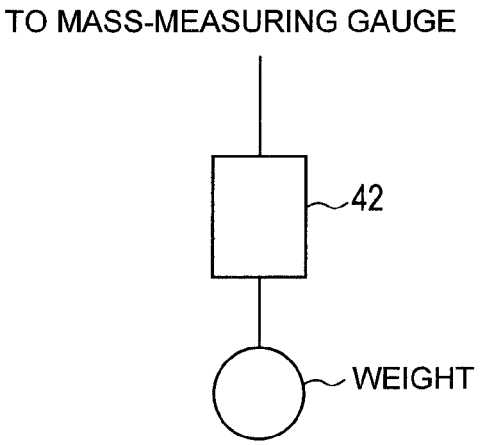
FIG. 8A illustrates how to measure the specific gravity of the elastic layer of the charging member.
Figure 8B:
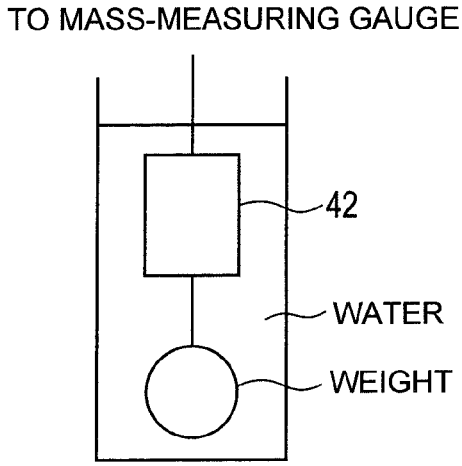
FIG. 8B illustrates how to measure the specific gravity of the elastic layer of the charging member.

Each rubber layer was cut out of the charging roller, and mass in the air and mass in the water were measured to calculate the specific gravity. In order that a fragment of each rubber layer cut out was completely sunk in the water, the mass in the air, W (g), was first measured in the state that, as shown in FIG. 8A, a weight made of a metal was attached to a sample 42, and then these were sunk in the water as shown in FIG. 8B, where their mass Ww (g) in the water was measured as it stands. Mass WO of the metal weight in the air and mass WwO thereof in the water were measured to calculate the specific gravity (SG) of each rubber layer, SG=(W−WO)/[(W−WO)−(Ww−WwO)]. WO and WwO were found almost equal, and hence these were presumed to be WO=WwO to calculate the specific gravity as SG=(W−WO)/(W−Ww).

Measurement of Vibration of Charging Roller

Figure 10:
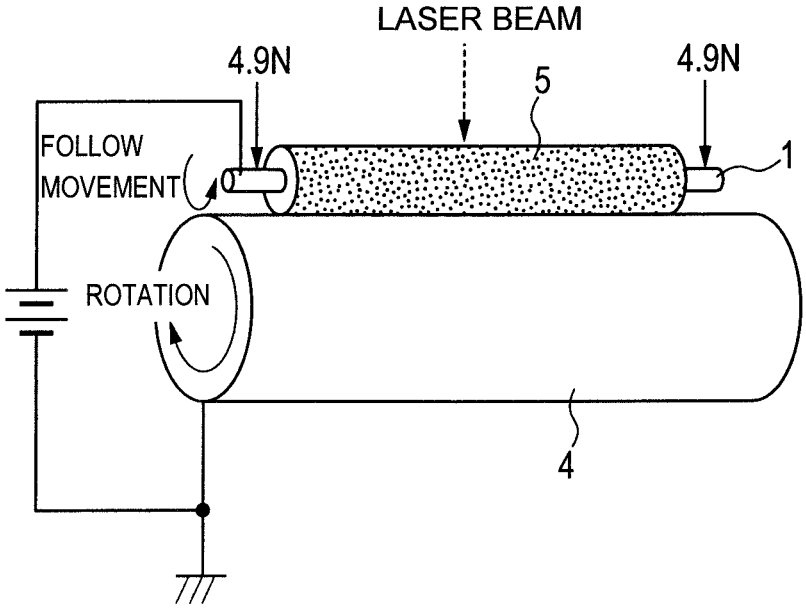
FIG. 10 illustrates how to measure the vibration caused in the charging member.

As shown in FIG. 10, a charging roller 5 produced was brought into contact with an electrophotographic photosensitive member 4 at the former's spring-loaded pressing force of 4.9 N at each end portion, i.e., at 9.8 N at both end portions in total, and the electrophotographic photosensitive member 4 was rotated at a speed of 45 mm/second. As the electrophotographic photosensitive member, what was used in a process cartridge of a monochrome laser beam printer (trade name: LASER JET P4515n; manufactured by Hewlett-Packard Japan, Ltd.) was taken off and used. To the charging roller, voltages were applied from the outside, conditions of which were a peak-to-peak voltage (Vpp) of 1,800 V as alternating-current voltage, having a frequency (f) of 2,930 Hz, and a direct-current voltage (Vdc) of −600V.

The magnitude of vibration (vibrational amplitude) of the charging roller being rotated following the rotation of the photosensitive member was measured with a laser Doppler vibroscope (trade name: LV-1710; manufactured by Ono Sokki Co., Ltd.). The positions of measurement were set at the middle in the lengthwise direction of the charging roller and at the position opposite to the position of its contact with the electrophotographic photosensitive member. After the vibration was measured, the vibration frequency was analyzed to find that a frequency of 5,860 Hz was largest. Accordingly, the magnitude of vibration (vibrational amplitude) of 5,860 Hz is shown in Table 13.

Image Evaluation

As the electrophotographic apparatus shown in FIG. 5, making use of the process cartridge shown in FIG. 6, a black-and-white laser beam printer (trade name: LASER JET P4515n; manufactured by Hewlett-Packard Japan, Ltd.) was readied. When used, voltages were applied to its charging member from the outside. An AC+DC charging system was employed, where the voltages applied to the charging member were a peak-to-peak voltage (Vpp) of 1,800 V as alternating-current voltage, having a frequency (f) of 2,930 Hz, and direct-current voltage (Vdc) of −600V. Images were reproduced at a resolution of 600 dpi.

Figure 9:
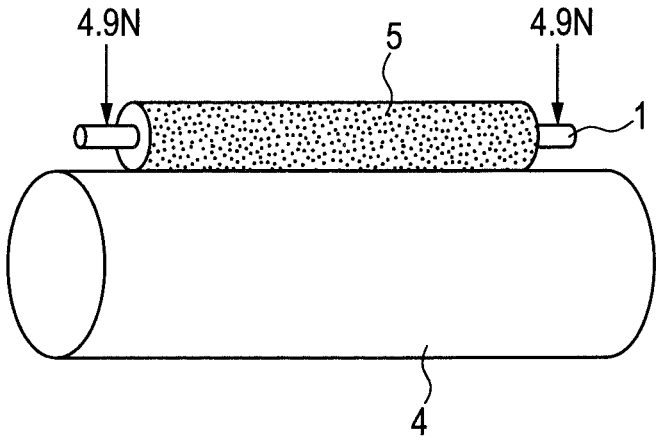
FIG. 9 illustrates how to evaluate the running performance of the charging member.

Three process cartridges for the above electrophotographic apparatus were readied, and the charging roller to be evaluated was attached to each process cartridge. Then, as shown in FIG. 9, a charging roller 5 was brought into contact with the photosensitive member 4 at the former's spring-loaded pressing force of 4.9 N at each end portion, i.e., at 9.8 N at both end portions in total. These process cartridges were each placed in an environment of temperature 15° C./humidity 10% RH (environment 1), an environment of temperature 23° C./humidity 50% RH (environment 2) and an environment of temperature 30° C./humidity 80% RH (environment 3) for 24 hours each to allow them to adapt to each environment. Thereafter, electrophotographic images were formed in each environment.

In forming the electrophotographic images, horizontal-line images of two dots in width and 176 dots in space in the direction perpendicular to the rotational direction of the photosensitive member were reproduced on 36,000 sheets. Here, a halftone image was reproduced on one sheet each after reproduction on 18,000 sheets, after reproduction on 24,000 sheets, after reproduction on 30,000 sheets and after reproduction on 36,000 sheets, of the above horizontal-line images. The halftone image is an image that forms horizontal lines of one dot in width and two dots in space in the direction perpendicular to the rotational direction of the photosensitive member.

The halftone images thus obtained on 4 sheets (hereinafter "halftone images No. 1 to No. 4") were visually observed to make the following evaluation 1 and evaluation 2. The evaluation 1 and evaluation 2 were made according to criteria shown in Table 5 below.

Evaluation 1: Evaluation on whether or not, and how much, there occur any image defects caused by faulty charging.

Evaluation 2: Evaluation on whether or not, and how much, there occur any image defects caused by scratches made on the surface of the photosensitive member.

The vibration of the charging roller in the course of the formation of electrophotographic images may accelerates the sticking of the toner and so forth to the surface of the charging roller, and the charging roller to which the toner and so forth have stuck may cause faulty charging. The vibration of the charging roller in the course of the formation of electrophotographic images may also come to make scratches on the surface of the photosensitive member. The present image evaluation is what is made in order to examine the correlation between the effect of keeping the charging roller from vibration and the grade of electrophotographic images.

As a typical example of the image defects caused by faulty charging, dots or horizontal streaks may be given. Meanwhile, as an example of the image defects caused by scratches made on the surface of the photosensitive member, vertical streaks may be given.

The formation of electrophotographic images by using the above electrophotographic apparatus was performed in an intermittent mode. The intermittent mode is a mode which repeats a cycle in which the rotation of the photosensitive member is stopped over a period of 3 seconds after electrophotographic images have been reproduced on two sheets. The halftone images obtained on 4 sheets were evaluated on any of their dot-like images, horizontally streaky images, coarse images and vertically streaky images according to the following criteria. The results are shown in Table 14.

TABLE 5

| Rank | Evaluation criteria |
|---|---|
| 1 | Any image defects are not seen. |
| 2 | Slight image defects are seen in some of the halftone images. |
| 3 | Slight image defects are seen in all the halftone images. |
| 4 | Clear image defects are seen. |

Measurement of Electrical Resistance

About the charging roller used in forming the electrophotographic images in the "environment 2" in the above image evaluation, its electrical resistance was calculated to make evaluation on any changes in electrical resistance with respect to the electrical resistance before its use in forming the electrophotographic images.

Where the charging roller has vibrated in the course of the formation of electrophotographic images, the electronic conduction agent or ionic conduction contained in the elastic layer moves slowly inside the elastic layer because of such vibration to make the elastic layer change in its electrical resistance. The evaluation thereon is what has been made in order to examine the correlation between the effect of keeping the charging roller from vibration and any changes with time in the electrical resistance of the charging roller.

Figure 4A:
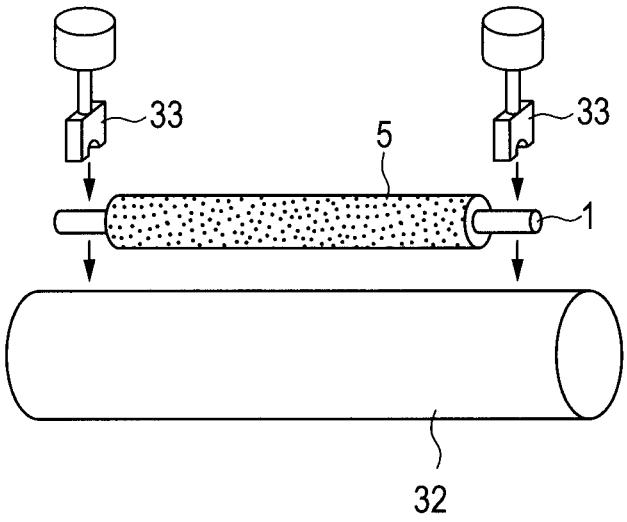
FIG. 4A illustrates how to measure the electrical resistance of the charging member according to the present invention.
Figure 4B:
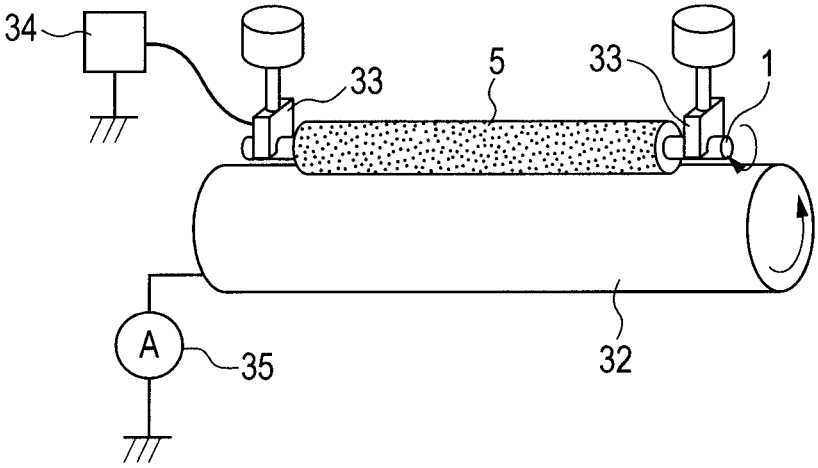
FIG. 4B illustrates how to measure the electrical resistance of the charging member according to the present invention.

The electrical resistance was determined in the following way. As shown in FIGS. 4A and 4B, by the aid of bearings 33 and 33 through each of which a load is kept applied, a substrate 1 is supported at its both end portions on a columnar metal 32 having the same curvature radius as the photosensitive member, in such a way that the former is in parallel to the latter (4A), a charging roller 5 is brought into contact with the columnar metal 32 (4B). In this state, the columnar metal 32 is rotated by means of a motor (not shown) and, while the charging roller 5 kept in contact is follow-up rotated, a direct-current voltage of −200 V is applied thereto from a stabilized power source 34. Here, the load applied to each of the bearings is set to be 4.9 N, the columnar metal is 30 mm in diameter and the columnar metal is rotated at a peripheral speed of 45 mm/second, where the electric current flowing to an ammeter is measured and the electrical resistance of the charging roller is calculated.

Here, the measurement of electric current of the charging roller before its use in the image evaluation and the measurement of electric current of the charging roller after its use in the image evaluation were made after the charging roller was placed in the "environment 2" for 24 hours to allow it to adapt to that environment.

The "environment 2" is an environment in which the sticking of the toner and so forth to the charging roller surface and the making of scratches on the photosensitive member surface can most not easily occur. Hence, as the charging roller to be evaluated, the charging roller used in forming the electrophotographic images in the "environment 2" is employed because the "environment 2" is considered to be the most suitable environment in order to make evaluation on any variations in electrical resistance that are caused by changes in conductivity of the elastic layer of the charging member that are due to the formation of electrophotographic images. The results are shown in Table 13.

Example 2

An elastic roller was produced in the same way as Example 1 except that the numbers of revolutions of screw portions of the cross-head extruder were so controlled as for the first rubber layer to be 2.1 mm in layer thickness and for the second rubber layer to be 1.4 mm in layer thickness. A surface layer coating fluid was prepared in the same way as Example 1 except that 30 parts by mass of carbon black (#52, available from Mitsubishi Chemical Corporation) was used in place of the composite conductive fine particles of Production Example 1 and the surface-treated titanium oxide particles of Production Example 2 and that the time of dispersion making use of the dispersion machine was changed to 36 hours. Thereafter, in the same way as Example 1, a charging roller 2 was produced, the electrical resistance, layer thickness, modulus of elasticity and specific gravity were measured, the natural vibration frequency was calculated and the evaluation was made on running tests.

Example 3

Materials for rubber layers were prepared in the same way as Example 2 except that, in the material for first rubber layer, the carbon black was not added and, in the material for second rubber layer, the carbon black was added in an amount changed to 100 parts by mass. A charging roller 3 was produced in the same way as Example 2 except that the above materials were used and that the numbers of revolutions of screw portions of the cross-head extruder were so controlled as for the first rubber layer to be 2.4 mm in layer thickness and for the second rubber layer to be 1.1 mm in layer thickness. Measurement and evaluation were each made in the same way as Example 1.

Example 4

A charging roller 4 was produced in the same way as Example 3 except that dies and the numbers of revolutions of screw portions of the cross-head extruder were so controlled as for the first rubber layer to be 1.0 mm in layer thickness and for the second rubber layer to be 1.25 mm in layer thickness and that the roller was so ground as to be 9.5 mm in outer diameter. Measurement and evaluation were each made in the same way as Example 1.

Example 5

A charging roller 5 was produced in the same way as Example 2 except that the numbers of revolutions of screw portions of the cross-head extruder were so controlled as for the first rubber layer to be 2.75 mm in layer thickness and for the second rubber layer to be 0.75 mm in layer thickness. Measurement and evaluation were each made in the same way as Example 1.

Example 6

A charging roller 6 was produced in the same way as Example 2 except that the numbers of revolutions of screw portions of the cross-head extruder were so controlled as for the first rubber layer to be 2.6 mm in layer thickness and for the second rubber layer to be 0.9 mm in layer thickness. Measurement and evaluation were each made in the same way as Example 1.

Example 7

A material for second rubber layer was prepared in the following way. To 100 parts by mass of acrylonitrile-butadiene rubber (NBR) (DN219; available from Nippon Zeon Co., Ltd.), components shown in Table 6 below were added, and these were kneaded for 15 minutes by means of a closed mixer temperature-controlled at 50° C.

TABLE 6

| | |
|---|---|
| Zinc stearate | 1 part by mass |
| Zinc oxide | 5 parts by mass |
| Calcium carbonate | 20 parts by mass |
| Carbon black (trade name: TOKA BLACK #7360SB; available from Tokai Carbon Co., Ltd.; volume-average particle diameter: 28 nm) | 40 parts by mass |

Next, to the kneaded product obtained, 1.2 parts by mass of sulfur as a vulcanizing agent and as vulcanization accelerators 1 part by mass of dibenzothiazyl sulfide (DM) and 1 part by mass of tetramethylthiuram monosulfide (TS) were added, and these were further kneaded for 10 minutes by means of a twin-roll mill kept cooled to a temperature of 20° C., to ready the material for second rubber layer.

A charging roller 7 was produced in the same way as Example 2 except that the material for second rubber layer thus obtained was used and that the numbers of revolutions of screw portions of the cross-head extruder were so controlled as for the first rubber layer to be 2.4 mm in layer thickness and for the second rubber layer to be 1.1 mm in layer thickness. Measurement and evaluation were each made in the same way as Example 1.

Example 8

A charging roller 8 was produced in the same way as Example 7 except that, in the material for second rubber layer, the carbon black was added in an amount changed to 45 parts by mass to prepare a material for second rubber layer and that the numbers of revolutions of screw portions of the cross-head extruder were so controlled as for the first rubber layer to be 2.3 mm in layer thickness and for the second rubber layer to be 1.2 mm in layer thickness. Measurement and evaluation were each made in the same way as Example 1.

Example 9

A charging roller 9 was produced in the same way as Example 7 except that, in the material for second rubber layer, the carbon black was added in an amount changed to 95 parts by mass to prepare a material for second rubber layer and that the numbers of revolutions of screw portions of the cross-head extruder were so controlled as for the first rubber layer to be 1.5 mm in layer thickness and for the second rubber layer to be 1.0 mm in layer thickness. Measurement and evaluation were each made in the same way as Example 1.

Example 10

A charging roller 10 was produced in the same way as Example 7 except that, in the material for first rubber layer, the carbon black was added in an amount changed to 5 parts by mass to prepare a material for first rubber layer and, in the material for second rubber layer, the carbon black was added in an amount changed to 80 parts by mass and 20 parts by mass of silica (R972, available from Aerosil Japan, Ltd.; average particle diameter: 16 nm) to prepare a material for second rubber layer and that the numbers of revolutions of screw portions of the cross-head extruder were so controlled as for the first rubber layer to be 2.0 mm in layer thickness and for the second rubber layer to be 1.5 mm in layer thickness. Measurement and evaluation were each made in the same way as Example 1.

Example 11

A charging roller 11 was produced in the same way as Example 7 except that, in the material for first rubber layer, the carbon black was added in an amount changed to 1 part by mass to prepare a material for first rubber layer and, in the material for second rubber layer, the carbon black was added in an amount changed to 50 parts by mass and 50 parts by mass of silica (R972, available from Aerosil Japan, Ltd.; average particle diameter: 16 nm) to prepare a material for second rubber layer and that the numbers of revolutions of screw portions of the cross-head extruder were so controlled as for the first rubber layer to be 1.8 mm in layer thickness and for the second rubber layer, to be 1.7 mm in layer thickness. Measurement and evaluation were each made in the same way as Example 1.

Example 12

A charging roller 12 was produced in the same way as Example 2 except that, in the material for second rubber layer, the acrylonitrile-butadiene rubber (NBR) was added in a n amount changed to 50 parts by mass, styrene-butadiene rubber (SBR) (JSR1500, available from JSR Corporation) was added in an amount of 50 parts by mass and the carbon black was changed for 50 parts by mass of TOKA BLACK #5500 (available from Tokai Carbon Co., Ltd.; volume-average particle diameter: 25 nm) to prepare a material for second rubber layer and that the numbers of revolutions of screw portions of the cross-head extruder were so controlled as for the first rubber layer to be 1.8 mm in layer thickness and for the second rubber layer to be 1.7 mm in layer thickness. Measurement and evaluation were each made in the same way as Example 1.

Example 13

A material for second rubber layer was prepared and a charging roller 13 was produced in the same way as Example 12 except that, in the material for second rubber layer, the acrylonitrile-butadiene rubber (NBR) was added in an amount changed to 70 parts by mass, the styrene-butadiene rubber (SBR) was added in an amount changed to 30 parts by mass and the carbon black was not added to prepare a material for second rubber layer. Measurement and evaluation were each made in the same way as Example 1.

Example 14

A material for second rubber layer was prepared in the same way as Example 12 except that, in the material for second rubber layer, 50 parts by mass of the acrylonitrile-butadiene rubber (NBR) (JSR230SV, available from JSR Corporation) was changed for 30 parts by mass of DN219 (available from Nippon Zeon Co., Ltd.) and the SBR was added in an amount changed to 70 parts by mass. A charging roller 14 was produced in the same way as Example 12 except that this material was used and that the numbers of revolutions of screw portions of the cross-head extruder were so controlled as for the first rubber layer to be 2.0 mm in layer thickness and for the second rubber layer to be 1.5 mm in layer thickness. Measurement and evaluation were each made in the same way as Example 1.

Example 15

A charging roller 15 was produced in the same way as Example 2 except that the numbers of revolutions of screw portions of the cross-head extruder were so controlled as for the first rubber layer to be 2.8 mm in layer thickness and for the second rubber layer to be 1.2 mm in layer thickness. Measurement and evaluation were each made in the same way as Example 1.

Example 16

A charging roller 16 was produced in the same way as Example 2 except that the numbers of revolutions of screw portions of the cross-head extruder were so controlled as for the first rubber layer to be 1.8 mm in layer thickness and for the second rubber layer to be 1.7 mm in layer thickness. Measurement and evaluation were each made in the same way as Example 1.

Example 17

A material for second rubber layer was prepared in the following way, To 100 parts by mass of styrene-butadiene rubber (SBR) (trade name: JSR1500, available from JSR Corporation), components shown in Table 7 below were added, and these were kneaded for 15 minutes by means of a closed mixer temperature-controlled at 50° C.

TABLE 7

| | |
|---|---|
| Zinc stearate | 1 part by mass |
| Zinc oxide | 5 parts by mass |
| Calcium carbonate | 20 parts by mass |
| Carbon black (trade name: SEAST S; available from Tokai Carbon Co., Ltd.; volume-average particle diameter: 66 nm) | 20 parts by mass |
| Silica (trade name: AEROSIL 90; available from Aerosil Japan, Ltd.; volume-average particle diameter: 20 nm) | 5 parts by mass |

Next, to the kneaded product obtained, 1.2 parts by mass of sulfur as a vulcanizing agent and as a vulcanization accelerator 4.5 parts by mass of tetrabenzylthiuram disulfide were added, and these were further kneaded for 15 minutes by means of a twin-roll mill kept cooled to 20° C., to obtain the material for second rubber layer.

A charging roller 17 was produced in the same way as Example 3 except that the material for second rubber layer thus obtained was used and that the numbers of revolutions of screw portions of the cross-head extruder were so controlled as for the first rubber layer to be 1.5 mm in layer thickness and for the second rubber layer to be 2.0 mm in layer thickness. Measurement and evaluation were each made in the same way as Example 1.

Example 18

A charging roller 18 was produced in the same way as Example 17 except that, in the material for first rubber layer, the calcium carbonate was added in an amount changed to 30 parts by mass and, in the material for second rubber layer, the carbon black was added in an amount changed to 40 parts by mass and the silica was added in an amount changed to 80 parts by mass to prepare materials for rubber layers and that the numbers of revolutions of screw portions of the cross-head extruder were so controlled as for the first rubber layer to be 1.6 mm in layer thickness and for the second rubber layer to be 1.9 mm in layer thickness. Measurement and evaluation were each made in the same way as Example 1.

Example 19

A charging roller 19 was produced in the same way as Example 17 except that, in the material for first rubber layer, the calcium carbonate was added in an amount changed to 30 parts by mass to prepare a material for first rubber layer and, in the material for second rubber layer, acrylonitrile-butadiene rubber (NBR) (JSR230SV, available from JSR Corporation) was used in place of the SBR, also 3 parts by mass of a quaternary ammonium salt (ADECASIZER LV-70, available from Asahi Denka Kogyo K.K.) was used in place of the carbon black and the silica was changed for 100 parts by mass of OX50 (available from Aerosil Japan, Ltd.; volume-average particle diameter: 30 nm) to prepare a material for second rubber layer and that the numbers of revolutions of screw portions of the cross-head extruder were so controlled as for the first rubber layer to be 1.8 mm in layer thickness and for the second rubber layer to be 1.7 mm in layer thickness. Measurement and evaluation were each made in the same way as Example 1.

Example 20

In material for first rubber layer, the calcium carbonate was added in an amount changed to 130 parts by mass to prepare a material for first rubber layer, and a material for second rubber layer was prepared in the following way. EPDM (EPT4045, available from Mitsui Chemicals, Inc.) was used in place of the acrylonitrile-butadiene rubber (NBR), and components shown in Table 8 below were added thereto, and these were kneaded for 15 minutes by means of a closed mixer temperature-controlled at 80° C.

TABLE 8

| | |
|---|---|
| Zinc stearate | 2 parts by mass |
| Zinc oxide | 5 parts by mass |
| Calcium carbonate | 15 parts by mass |
| Carbon black (trade name: SEAST SO; available from Tokai Carbon Co., Ltd.; volume-average particle diameter: 43 nm) | 100 parts by mass |
| Paraffin oil (PW380, available from Idemitsu Petrochemical Co., Ltd.) | 20 parts by mass |

Next, to the kneaded product obtained, 1 part by mass of sulfur as a vulcanizing agent and as vulcanization accelerators 1 part by mass of dibenzothiazyl sulfide (DM) and 1 part by mass of tetramethylthiuram monosulfide (TS) were added, and these were further kneaded for 10 minutes by means of a twin-roll mill kept cooled to a temperature of 25° C., to obtain the material for second rubber layer.

A charging roller 20 was produced in the same way as Example 2 except that the materials for rubber layers thus obtained were used and that the numbers of revolutions of screw portions of the cross-head extruder were so controlled as for the first rubber layer to be 1.5 mm in layer thickness and for the second rubber layer to be 2.0 mm in layer thickness and, when the roller was ground, the number of revolutions of the grinder was controlled taking care so as for any rubber not to peel. Measurement and evaluation were each made in the same way as Example 1.

Example 21

A charging roller 21 was produced in the same way as Example 20 except that the numbers of revolutions of screw portions of the cross-head extruder were so controlled as for the first rubber layer to be 1.6 mm in layer thickness and for the second rubber layer to be 1.9 mm in layer thickness. Measurement and evaluation were each made in the same way as Example 1.

Example 22

A charging roller 22 was produced in the same way as Example 20 except that the numbers of revolutions of screw portions of the cross-head extruder were so controlled as for the first rubber layer to be 1.4 mm in layer thickness and for the second rubber layer to be 2.1 mm in layer thickness. Measurement and evaluation were each made in the same way as Example 1.

Example 23

Substrate

A substrate made of stainless steel and being 6 mm in diameter and 252.5 mm in length was coated with a fluorine resin (FC4430, available from Sumitomo 3M Limited) as a primer, followed by drying, and this was used as a conductive substrate.

Materials for Elastic Layer

To 100 parts by mass of a polyol vulcanized binary fluorine rubber (DAI-EL G-755L, available from Daikin Industries, Ltd.), components shown in Table 9 below were kneaded for 10 minutes by means of a closed mixer temperature-controlled at 50° C., to obtain a material for first rubber layer.

TABLE 9

| | |
|---|---|
| Tin oxide (trade name: S-1; available from Mitsubishi Materials Electronic Chemicals Co., Ltd.; volume-average particle diameter: 30 nm) | 100 parts by mass |
| Magnesium oxide (trade name: KYOWAMAG MA-150, available from Kyowa Chemical Industry Co., Ltd.) | 3 parts by mass |
| Calcium hydroxide (trade name: CALDIC-2000, available from Ohmi Chemical Industry Co., Ltd.) | 6 parts by mass |

A material for second rubber layer was also readied in the same way as Example 20.

Charging Roller

Using only one extrusion screw of the double-layer simultaneous cross-head extruder as shown in FIG. 7, the material for first rubber layer was extruded together with the substrate in such a way as to be coaxially formed around the substrate to produce a roller having the substrate and laminated on its peripheral surface the first rubber layer, which stood unvulcanized. The extrusion was so controlled that the roller was 9 mm in outer diameter. The material for second rubber layer was molded in the shape of a sheet of about 2 mm in thickness, which sheet was then wound around the above roller. End portions of the rubber layers formed were removed by cutting. Then, this roller was placed in a mold having a cylindrical cavity of 12.5 mm in internal diameter, and was heated at a temperature of 160° C. for 15 minutes. Thereafter, this was demolded from the mold, and was further heated for 10 minutes in a hot-air oven kept at a temperature of 170° C., to effect secondary vulcanization.

The roller obtained was ground on the peripheral surface of the elastic layer by means of a cylindrical grinder of a plunge cutting system so as to be shaped into a roller of 224.2 mm in rubber-part length and 12 mm in external diameter, to obtain an elastic roller. When the roller was ground, the number of revolutions of the grinder was controlled taking care so as for any rubber not to peel. A surface layer was formed on this elastic roller in the same way as Example 2 to produce a charging roller 23, and measurement and evaluation were each made thereon in the same way as Example 1.

Example 24

A material for first rubber layer was readied in the same way as Example 1 except that, in the material for first rubber layer, 100 parts by mass of tin oxide (S-1, available from Mitsubishi Materials Electronic Chemicals Co., Ltd.; average particle diameter: 30 nm) was added in place of the calcium carbonate and carbon black. Also, in the material for second rubber layer in Example 1, styrene-butadiene rubber (SBR) (JSR1503, available from JSR Corporation) was used in place of the EPDM, the zinc stearate was added in an amount changed to 1 part by mass and the calcium carbonate and the paraffin oil were not used.

Except for the foregoing, the materials were prepared in the same way as Example 20. A charging roller 24 was produced in the same way as Example 2 except that the materials for rubber layers thus obtained were used and that the numbers of revolutions of screw portions of the cross-head extruder were so controlled as for the first rubber layer to be 2.0 mm in layer thickness and for the second rubber layer to be 1.5 mm in layer thickness. Measurement and evaluation were each made in the same way as Example 1.

Example 25

An elastic roller was produced in the same way as Example 24 except that the tin oxide was added in an amount changed to 80 parts by mass. A surface layer was formed thereon by using a surface layer coating fluid prepared in the following way. Ethanol was added to polyvinyl butyral, to control its solid content so as to be 20% by mass. To 500 parts by mass of the solution obtained (100 parts by mass of polyvinyl butyral solid content), components shown in Table 10 below were added to prepare a mixture solution.

TABLE 10

| | |
|---|---|
| Carbon black (#52, available from Mitsubishi Chemical Corporation) | 30 parts by mass |
| Modified dimethylsilicone oil (trade name: SH28PA; available from Dow Corning Toray Silicone Co., Ltd.) | 0.08 part by mass |

190.4 g of the above mixture solution was put into a glass bottle of 450 ml in internal volume together with 200 g of glass beads of 0.8 mm in volume-average particle diameter as dispersion media, followed by dispersion for 24 hours by using a paint shaker dispersion machine. After the dispersion was completed, 3.2 g of polymethyl methacrylate resin particles (in an amount corresponding to 10 parts by mass based on 100 parts by mass of the polyvinyl butyral solid content) of 6 μm in average particle diameter were added thereto. A charging roller 25 was produced in the same way as Example 24 except for the above, and measurement and evaluation were each made in the same way as Example 1.

Example 26

A charging roller 26 was produced in the same way as Example 25 except that, in the material for first rubber layer, 10 parts by mass of EPDM (EPT4045, available from Mitsui Chemicals, Inc.) was added and the tin oxide was added in an amount changed to 150 parts by mass to prepare a material for first rubber layer. Measurement and evaluation were each made in the same way as Example 1.

Example 27

Materials for rubber layers were prepared in the same way as Example 26 except that, in the material for first rubber layer, the epichlorohydrin rubber (EO-EP-AGE terpolymer) was added in an amount changed to 50 parts by mass, the EPDM (EPT4045, available from Mitsui Chemicals, Inc.) was changed for 50 parts by mass of acrylonitrile-butadiene rubber (NBR) (DN219; available from Nippon Zeon Co., Ltd.) and the tin oxide was added in an amount changed to 170 parts by mass. A charging roller 27 was produced in the same way as Example 26 except that these materials were used and that the numbers of revolutions of screw portions of the cross-head extruder were so controlled as for the first rubber layer to be 2.0 mm in layer thickness and for the second rubber layer to be 1.5 mm in layer thickness. Measurement and evaluation were each made in the same way as Example 1.

Example 28

A charging roller 28 was produced in the same way as Example 27 except that the numbers of revolutions of screw portions of the cross-head extruder were so controlled as for the first rubber layer to be 2.2 mm in layer thickness and for the second rubber layer to be 1.3 mm in layer thickness. Measurement and evaluation were each made in the same way as Example 1.

Example 29

Materials for rubber layers were prepared in the same way as Example 2 except that, in the material for second rubber layer, the carbon black was changed for 50 parts by mass of TOKA BLACK #5500 (available from Tokai Carbon Co., Ltd.; volume-average particle diameter: 25 nm). A charging, roller 29 was produced in the same way as Example 2 except that these materials were used and that the numbers of revolutions of screw portions of the cross-head extruder were so controlled as for the first rubber layer to be 2.5 mm in layer thickness and for the second rubber layer to be 1.0 mm in layer thickness. Measurement and evaluation were each made in the same way as Example 1.

Example 30

Materials for rubber layers were prepared in the same way as Example 2 except that, in the material for second rubber layer, the carbon black was changed for 42 parts by mass of TOKA BLACK #4300 (available from Tokai Carbon Co., Ltd.; volume-average particle diameter: 25 nm) and the carbon black was added in an amount changed to 60 parts by mass. A charging roller 30 was produced in the same way as Example 2 except that these materials were used and that the numbers of revolutions of screw portions of the cross-head extruder were so controlled as for the first rubber layer to be 2.6 mm in layer thickness and for the second rubber layer to be 0.9 mm in layer thickness and the elastic roller was so made as to be 12 mm in external diameter. Measurement and evaluation were each made in the same way as Example 1.

Example 31

Materials for rubber layers were prepared in the same way as Example 29 except that, in the material for first rubber layer, the calcium carbonate was added in an amount changed to 150 parts by mass and, in the material for second rubber layer, the carbon black was added in an amount changed to 60 parts by mass. A charging roller 31 was produced in the same way as Example 29 except that these materials were used and that the numbers of revolutions of screw portions of the cross-head extruder were so controlled as for the first rubber layer to be 2.0 mm in layer thickness and for the second rubber layer to be 1.5 mm in layer thickness. Measurement and evaluation were each made in the same way as Example 1.

Example 32

Materials for rubber layers were prepared in the same way as Example 31 except that, in the material for second rubber layer, the carbon black was added in an amount changed to 100 parts by mass. A charging roller 32 was produced in the same way as Example 31 except that this material was used and that the numbers of revolutions of screw portions of the cross-head extruder were so controlled as for the first rubber layer to be 2.2 mm in layer thickness and for the second rubber layer to be 1.3 mm in layer thickness. Measurement and evaluation were each made in the same way as Example 1.

Example 33

A charging roller 33 was produced in the same way as Example 32 except that the numbers of revolutions of screw portions of the cross-head extruder were so controlled as for the first rubber layer to be 2.5 mm in layer thickness and for the second rubber layer to be 0.9 mm in layer thickness and the elastic roller was so made as to be 11.8 mm in external diameter. Measurement and evaluation were each made in the same way as Example 1.

Example 34

A material for first rubber layer was prepared in the same way as Example 2 except that, in the material for first rubber layer, the epichlorohydrin rubber was changed for an EO-EP-AGE terpolymer with EO/EP/AGE=40 mol %/56 mol %/4 mol % and the carbon black was not used. A material for second rubber layer was prepared in the same way as Example 25. A charging roller 34 was produced in the same way as Example 25 except that these materials were used and that the numbers of revolutions of screw portions of the cross-head extruder were so controlled as for the first rubber layer to be 2.3 mm in layer thickness and for the second rubber layer to be 0.9 mm in layer thickness and the elastic roller was so made as to be 11.4 mm in external diameter. Measurement and evaluation were each made in the same way as Example 1.

Example 35

A material for first rubber layer was prepared in the same way as Example 34 except that, in the material for first rubber layer, carbon black (THERMAX FLOFORM N990; available from Cancab Technologies Ltd., Canada; volume-average particle diameter: 270 nm) was added in an amount of 5 parts by mass. A material for second rubber layer was prepared in the same way as Example 2 except that the calcium carbonate was not added.

A charging roller 35 was produced in the same way as Example 25 except that these materials were used and that the numbers of revolutions of screw portions of the cross-head extruder were so controlled as for the first rubber layer to be 1.7 mm in layer thickness and for the second rubber layer to be 1.8 mm in layer thickness. Measurement and evaluation were each made in the same way as Example 1.

Example 36

A material for first rubber layer was prepared in the same way as Example 20 except that the tin oxide was changed for 5 parts by mass of carbon black (TOKA BLACK #7360SB; available from Tokai Carbon Co., Ltd.; volume-average particle diameter: 28 nm). A material for second rubber layer was prepared in the same way as Example 20 except that the carbon black was added in an amount changed to 15 parts by mass and the calcium carbonate was added in an amount changed to 20 parts by mass. A charging roller 36 was produced in the same way as Example 35 except that these materials were used and that the numbers of revolutions of screw portions of the cross-head extruder were so controlled as for the first rubber layer to be 2.0 mm in layer thickness and for the second rubber layer to be 1.0 mm in layer thickness and, when the roller was ground, the number of revolutions of the grinder was controlled taking care so as for any rubber not to peel. Measurement and evaluation were each made in the same way as Example 1.

Example 37

A charging roller 37 was produced in the same way as Example 36 except that dies and the numbers of revolutions of screw portions of the cross-head extruder were so controlled as for the first rubber layer to be 3.5 mm in layer thickness and for the second rubber layer to be 0.9 mm in layer thickness and the elastic roller was so made as to be 13.8 mm in external diameter. Measurement and evaluation were each made in the same way as Example 1.

Example 38

A material for first rubber layer was prepared in the same way as Example 23 except that the tin oxide was changed for 50 parts by mass of carbon black (TOKA BLACK #7360SB; available from Tokai Carbon Co., Ltd.; volume-average particle diameter: 28 nm). A material for second rubber layer was prepared in the same way as Example 17 except that the silica was not added and the carbon black was added in an amount changed to 50 parts by mass. A charging roller 38 was produced in the same way as Example except that these materials were used and that the number of revolutions of a screw portion of the cross-head extruder was so controlled as for the first rubber layer to be 2.0 mm in layer thickness and the thickness of the rubber sheet was so controlled as for the second rubber layer to be 1.5 mm in layer thickness. Measurement and evaluation were each made in the same way as Example 1.

Example 39

A charging roller 39 was produced in the same way as Example 38 except that a die and the number of revolutions of a screw portion of the cross-head extruder were so controlled as for the first rubber layer to be 1.1 mm in layer thickness and the thickness of the rubber sheet was so controlled as for the second rubber layer to be 1.4 mm in layer thickness and that the elastic roller was so made as to be 10.0 mm in external diameter. Measurement and evaluation were each made in the same way as Example 1.

Example 40

A charging roller 40 was produced in the same way as Example 24 except that the numbers of revolutions of screw portions of the cross-head extruder were so controlled as for the first rubber layer to be 1.5 mm in layer thickness and for the second rubber layer to be 2.0 mm in layer thickness. Measurement and evaluation were each made in the same way as Example 1.

Example 41

A material for first rubber layer was prepared by mixing materials shown in Table 11 below.

TABLE 11

| | |
|---|---|
| Polyol (trade name: NIPPOLAN N-4032; available from Nippon Polyurethane Industry Co., Ltd.) | 100 part by mass |
| Polyisocyanate (trade name: TDI-80; available from Nippon Polyurethane Industry Co., Ltd.) | 7 parts by mass |
| Carbon black (trade name: SEAST S; available from Tokai Carbon Co., Ltd.; volume-average particle diameter: 66 nm) | 20 parts by mass |

A substrate prepared in the same way as Example 1 was set in a mold having a cylindrical cavity, and the material for first rubber layer was injected thereinto, which was then heated for 30 minutes in a 100° C. hot-air oven. The product obtained was so controlled as to be 11 mm in outer diameter to produce a roller having a first rubber layer with which the substrate was covered. A material for second rubber layer prepared in the same way as Example 38 was also molded in the shape of a sheet of about 1 mm in thickness to prepare a second rubber layer. Except for these, a charging roller 41 was produced in the same way as Example 23. Measurement and evaluation were each made in the same way as Example 1.

Example 42

A material for first rubber layer was prepared in the same way as Example 23 except that the tin oxide was added in an amount changed to 170 parts by mass. A material for second rubber layer was prepared in the same way as Example 17 except that butadiene rubber (BR) (JSRBR01, available from JSR Corporation) was used in place of the SBR, the silica was not added and the carbon black was added in an amount changed to 100 parts by mass.

A charging roller 42 was produced in the same way as Example 23 except that the above materials were used and that a die and the number of revolutions of a screw portion of the cross-head extruder were so controlled as for the first rubber layer to be 2.3 mm in layer thickness and the thickness of the rubber sheet was so controlled as for the second rubber layer to be 1.2 mm in layer thickness and that the elastic roller was so made as to be 12.05 mm in external diameter. Measurement and evaluation were each made in the same way as Example 1.

Example 43

A material for first rubber layer was prepared in the same way as Example 23 except that the tin oxide was changed for 30 parts by mass of carbon black (TOKA BLACK #7360SB; available from Tokai Carbon Co., Ltd.; volume-average particle diameter: 28 nm). A material for second rubber layer was prepared in the same way as Example 42. A charging roller 43 was produced in the same way as Example 41 except that these materials were used. Measurement and evaluation were each made in the same way as Example 1.

Example 44

Materials for rubber layers were prepared in the same way as Example 7 except that, in the material for first rubber layer, the carbon black was not added and, in the material for second rubber layer, 2 parts by mass of quaternary ammonium salt (trade name: ADECASIZER LV-70; available from Asahi Denka Kogyo K.K.) was used in place of the carbon black.

A charging roller 44 was produced in the same way as Example 7 except that the above materials were used and that the numbers of revolutions of screw portions of the cross-head extruder were so controlled as for the first rubber layer to be 2.5 mm in layer thickness and for the second rubber layer to be 1.0 mm in layer thickness and the elastic roller was so made as to be 12 mm in external diameter. Measurement and evaluation were each made in the same way as Example 1.

The results of the measurement and calculation in the above Examples 2 to 44 are shown in Tables 12 and 13. The results of the image evaluation in the above Examples 2 to 44 are also shown in Table 14.

Comparative Example 1

A material for first rubber layer was prepared in the same way as Example 34 except that, in the material for first rubber layer, carbon black (THERMAX FLOFORM N990; available from Cancab Technologies Ltd., Canada; volume-average particle diameter: 270 nm) was added in an amount of 5 parts by mass. As a material for second rubber layer, it was prepared in the same way as Example 9 except that the carbon black was added in an amount changed to 48 parts by mass. A charging roller 45 was produced in the same way as Example 25 except that these materials were used and that the numbers of revolutions of screw portions of the cross-head extruder were so controlled as for the first rubber layer to be 1.0 mm in layer thickness and for the second rubber layer to be 1.6 mm in layer thickness and the elastic roller was so made as to be 10.2 mm in external diameter. Measurement and evaluation were each made in the same way as Example 1.

Comparative Example 2

Materials for rubber layers were prepared in the same way as Comparative Example 1 except that, in the material for first rubber layer, the carbon black was not added and, in the material for second rubber layer, 2 parts by mass of quaternary ammonium salt (ADECASIZER LV-70, available from Asahi Denka Kogyo K.K.) was used in place of the carbon black. A charging roller 46 was produced in the same way as Comparative Example 1 except that these materials were used and that the numbers of revolutions of screw portions of the cross-head extruder were so controlled as for the first rubber layer to be 1.5 mm in layer thickness and for the second rubber layer to be 2.0 mm in layer thickness and the elastic roller was so made as to be 12.0 mm in external diameter. Measurement and evaluation were each made in the same way as Example 1.

Comparative Example 3

A charging roller 47 was produced in the same way as Comparative Example 2 except that the numbers of revolutions of screw portions of the cross-head extruder were so controlled as for the first rubber layer to be 1.0 mm in layer thickness and for the second rubber layer to be 1.6 mm in layer thickness and the elastic roller was so made as to be 10.2 mm in external diameter. Measurement and evaluation were each made in the same way as Example 1.

Comparative Example 4

A material for first rubber layer was prepared in the same way as Example 36 except that the carbon black was not added thereto. As to a material for second rubber layer, it was prepared in the same way as Example 36 except that the calcium carbonate was not added and the carbon black was added in an amount changed to 5 parts by mass. A charging roller 48 was produced in the same way as Example except that these materials were used and that the numbers of revolutions of screw portions of the cross-head extruder were so controlled as for the first rubber layer to be 1.8 mm in layer thickness and for the second rubber layer to be 1.7 mm in layer thickness and the elastic roller was so made as to be 12.0 mm in external diameter. Measurement and evaluation were each made in the same way as Example 1.

Comparative Example 5

A material for first rubber layer and a material for second rubber layer were prepared in the same way as Comparative Example 4 except that the calcium carbonate in the latter material was added in an amount changed to 20 parts by mass. A charging roller 49 was produced in the same way as Comparative Example 4 except that these materials were used and that dies and the numbers of revolutions of screw portions of the cross-head extruder were so controlled as for the first rubber layer to be 2.0 mm in layer thickness and for the second rubber layer to be 1.3 mm in layer thickness and the elastic roller was so made as to be 11.6 mm in external diameter. Measurement and evaluation were each made in the same way as Example 1.

Comparative Example 6

As to a material for first rubber layer, it was prepared in the same way as Comparative Example 1 except that the calcium carbonate and the carbon black were not added thereto. As to a material for second rubber layer, it was prepared in the same way as Comparative Example 5 except that the carbon black was added in an amount changed to 50 parts by mass. A charging roller 50 was produced in the same way as Comparative Example 1 except that these materials were used and that dies and the numbers of revolutions of screw portions of the cross-head extruder were so controlled as for the first rubber layer to be 2.0 mm in layer thickness and for the second rubber layer to be 3.5 mm in layer thickness and the elastic roller was so made as to be 16.0 mm in external diameter. Measurement and evaluation were each made in the same way as Example 1.

Comparative Example 7

A charging roller 51 was produced in the same way as Comparative Example 1 except that, as a material for first rubber layer and a material for second rubber layer each, the same material for second rubber layer as Comparative Example 2 was prepared and that dies and the numbers of revolutions of screw portions of the cross-head extruder were so controlled as for the first rubber layer to be 2.0 mm in layer thickness and for the second rubber layer to be 1.5 mm in layer thickness and the elastic roller was so made as to be 12.0 mm in external diameter. Measurement and evaluation were each made in the same way as Example 1.

The results of the measurement and calculation in the above Comparative Examples 1 to 7 are shown in Tables 12 and 13. The results of the image evaluation in the above Comparative Examples 1 to 7 are also shown in Table 15.

TABLE 12

| | Charging roller No. | Layer thickness (mm) First rubber layer | Second rubber layer | First/ second ratio | Surface layer thickness (μm) | Modulus of elasticity (MPa)) First rubber layer | Second rubber layer | Specific gravity First rubber layer | Second rubber layer |
|---|---|---|---|---|---|---|---|---|---|
| Ex. 1 | 1 | 2.5 | 0.5 | 0.20 | 15.00 | 4.4 | 17 | 1.5 | 1.3 |
| Ex. 2 | 2 | 2.1 | 0.9 | 0.43 | 20.00 | 4.4 | 17 | 1.5 | 1.3 |
| Ex. 3 | 3 | 2.4 | 0.6 | 0.25 | 14.00 | 3.4 | 43 | 1.5 | 1.4 |
| Ex. 4 | 4 | 1.0 | 0.8 | 0.75 | 11.00 | 3.4 | 43 | 1.5 | 1.4 |
| Ex. 5 | 5 | 2.8 | 0.3 | 0.09 | 12.00 | 4.4 | 17 | 1.5 | 1.3 |
| Ex. 6 | 6 | 2.6 | 0.4 | 0.15 | 12.00 | 4.4 | 17 | 1.5 | 1.3 |
| Ex. 7 | 7 | 2.4 | 0.6 | 0.25 | 11.00 | 4.4 | 10 | 1.5 | 1.3 |
| Ex. 8 | 8 | 2.3 | 0.7 | 0.30 | 11.00 | 4.4 | 14 | 1.5 | 1.3 |
| Ex. 9 | 9 | 1.5 | 0.5 | 0.33 | 11.00 | 4.4 | 34 | 1.5 | 1.4 |
| Ex. 10 | 10 | 2.0 | 1.0 | 0.50 | 13.00 | 4.4 | 40 | 1.5 | 1.4 |
| Ex. 11 | 11 | 1.8 | 1.2 | 0.67 | 13.00 | 4.4 | 43 | 1.5 | 1.4 |
| Ex. 12 | 12 | 1.8 | 1.2 | 0.67 | 13.00 | 4.4 | 17 | 1.5 | 1.3 |
| Ex. 13 | 13 | 1.7 | 1.2 | 0.71 | 13.00 | 4.4 | 26 | 1.5 | 1.3 |
| Ex. 14 | 14 | 2.0 | 1.0 | 0.50 | 12.00 | 4.4 | 45 | 1.5 | 1.3 |
| Ex. 15 | 15 | 2.7 | 0.2 | 0.07 | 12.00 | 4.4 | 17 | 1.5 | 1.3 |
| Ex. 16 | 16 | 1.8 | 1.2 | 0.67 | 12.00 | 4.4 | 17 | 1.5 | 1.3 |
| Ex. 17 | 17 | 1.5 | 1.5 | 1.00 | 12.00 | 3.5 | 34 | 1.5 | 1.1 |
| Ex. 18 | 18 | 1.6 | 1.4 | 0.88 | 12.00 | 3.4 | 48 | 1.4 | 1.3 |
| Ex. 19 | 19 | 1.8 | 1.2 | 0.67 | 15.00 | 3.4 | 35 | 1.4 | 1.0 |
| Ex. 20 | 20 | 1.5 | 1.5 | 1.00 | 5.00 | 3.4 | 35 | 1.7 | 1.2 |
| Ex. 21 | 21 | 1.6 | 1.4 | 0.88 | 3.00 | 3.4 | 35 | 1.7 | 1.2 |
| Ex. 22 | 22 | 1.4 | 1.6 | 1.14 | 9.00 | 3.4 | 35 | 1.7 | 1.2 |
| Ex. 23 | 23 | 1.5 | 1.5 | 1.00 | 10.00 | 4.5 | 35 | 2.8 | 1.2 |
| Ex. 24 | 24 | 2.0 | 1.0 | 0.50 | 12.00 | 6.9 | 35 | 2.1 | 1.3 |
| Ex. 25 | 25 | 2.0 | 1.0 | 0.50 | 25.00 | 5.2 | 35 | 2.1 | 1.3 |
| Ex. 26 | 26 | 2.0 | 1.0 | 0.50 | 30.00 | 5.2 | 35 | 2.2 | 1.3 |
| Ex. 27 | 27 | 2.0 | 1.0 | 0.50 | 35.00 | 5.2 | 35 | 2.4 | 1.3 |
| Ex. 28 | 28 | 2.2 | 0.8 | 0.36 | 30.00 | 5.2 | 35 | 2.2 | 1.3 |
| Ex. 29 | 29 | 2.5 | 0.5 | 0.20 | 13.00 | 3.4 | 35 | 1.5 | 1.3 |
| Ex. 30 | 30 | 2.6 | 0.4 | 0.15 | 12.00 | 3.4 | 39 | 1.5 | 1.3 |
| Ex. 31 | 31 | 2.0 | 1.0 | 0.50 | 10.00 | 3.5 | 39 | 1.8 | 1.3 |
| Ex. 32 | 32 | 2.2 | 0.8 | 0.36 | 10.00 | 3.4 | 39 | 1.8 | 1.3 |
| Ex. 33 | 33 | 2.5 | 0.4 | 0.16 | 10.00 | 3.4 | 39 | 1.8 | 1.3 |
| Ex. 34 | 34 | 2.3 | 0.4 | 0.17 | 32.00 | 3.4 | 34 | 1.5 | 1.3 |
| Ex. 35 | 35 | 1.7 | 1.3 | 0.76 | 32.00 | 4.5 | 17 | 1.5 | 1.3 |
| Ex. 36 | 36 | 2.0 | 0.5 | 0.25 | 48.00 | 4.5 | 8.6 | 1.2 | 1.2 |
| Ex. 37 | 37 | 3.5 | 0.4 | 0.11 | 49.00 | 4.5 | 8.6 | 1.2 | 1.2 |
| Ex. 38 | 38 | 2.0 | 1.0 | 0.50 | 9.00 | 11.9 | 34 | 1.8 | 1.2 |
| Ex. 39 | 39 | 1.1 | 0.9 | 0.82 | 9.00 | 15.3 | 51 | 1.8 | 1.2 |
| Ex. 40 | 40 | 1.5 | 2.0 | 1.33 | 12.00 | 6.8 | 34 | 2.1 | 1.3 |
| Ex. 41 | 41 | 2.5 | 0.5 | 0.20 | 10.00 | 34 | 34 | 1.2 | 1.2 |
| Ex. 42 | 42 | 2.3 | 0.7 | 0.30 | 10.00 | 5.1 | 43 | 3.3 | 1.2 |
| Ex. 43 | 43 | 1.1 | 0.9 | 0.82 | 25.00 | 11.9 | 43 | 1.8 | 1.1 |
| Ex. 44 | 44 | 2.5 | 0.5 | 0.20 | 12.00 | 4.3 | 4.4 | 1.5 | 1.0 |
| Cp. 1 | 45 | 1.0 | 1.1 | 1.10 | 23.00 | 4.4 | 17 | 1.5 | 1.3 |
| Cp. 2 | 46 | 1.5 | 1.5 | 1.00 | 15.00 | 3.4 | 5.2 | 1.5 | 1.0 |
| Cp. 3 | 47 | 1.0 | 1.1 | 1.10 | 21.00 | 3.5 | 5.2 | 1.5 | 1.0 |
| Cp. 4 | 48 | 1.8 | 1.2 | 0.67 | 35.00 | 4.3 | 8.7 | 1.2 | 0.9 |
| Cp. 5 | 49 | 2.0 | 0.8 | 0.40 | 34.00 | 12 | 14 | 1.3 | 1.0 |
| Cp. 6 | 50 | 2.0 | 3.0 | 1.50 | 39.00 | 3.5 | 8.4 | 1.3 | 1.1 |
| Cp. 7 | 51 | 2.0 | 1.0 | 0.50 | 25.00 | 17 | 17 | 1.3 | 1.3 |

Ex.: Example; Cp.: Comparative Example

TABLE 13

| | Natural vibration frequency (Hz) First rubber layer | Second rubber layer | First/ second ratio | Charging roller vibration magnitude (nm) | Electrical resistance (Ω) Before running | After running | Changes in electrical resistance (Initial stage as "1") |
|---|---|---|---|---|---|---|---|
| Ex. 1 | 172 | 824 | 4.8 | 5 | $1.1 \times 10^5$ | $1.3 \times 10^5$ | 1.2 |
| Ex. 2 | 187 | 614 | 3.3 | 6 | $8.2 \times 10^4$ | $1.0 \times 10^5$ | 1.2 |
| Ex. 3 | 154 | 1146 | 7.4 | 6 | $1.0 \times 10^5$ | $1.2 \times 10^5$ | 1.2 |
| Ex. 4 | 239 | 1025 | 4.3 | 8 | $1.2 \times 10^5$ | $1.5 \times 10^5$ | 1.3 |
| Ex. 5 | 164 | 1165 | 7.1 | 15 | $2.0 \times 10^5$ | $9.8 \times 10^5$ | 4.9 |
| Ex. 6 | 168 | 926 | 5.5 | 12 | $2.0 \times 10^5$ | $6.0 \times 10^5$ | 3.0 |

TABLE 13-continued

| | Natural vibration frequency (Hz) | | | Charging roller | Electrical resistance (Ω) | | Changes in electrical resistance |
|---|---|---|---|---|---|---|---|
| | First rubber layer | Second rubber layer | First/second ratio | vibration magnitude (nm) | Before running | After running | (Initial stage as "1") |
| Ex. 7 | 175 | 590 | 3.4 | 9 | $2.5 \times 10^5$ | $4.0 \times 10^5$ | 1.6 |
| Ex. 8 | 179 | 628 | 3.5 | 10 | $2.3 \times 10^5$ | $4.5 \times 10^5$ | 2.3 |
| Ex. 9 | 222 | 1133 | 5.1 | 9 | $1.4 \times 10^5$ | $2.5 \times 10^5$ | 1.8 |
| Ex. 10 | 193 | 853 | 4.4 | 8 | $1.4 \times 10^5$ | $2.2 \times 10^5$ | 1.6 |
| Ex. 11 | 205 | 808 | 3.9 | 7 | $1.7 \times 10^5$ | $2.4 \times 10^5$ | 1.4 |
| Ex. 12 | 203 | 538 | 2.7 | 11 | $2.2 \times 10^5$ | $4.2 \times 10^5$ | 1.9 |
| Ex. 13 | 209 | 648 | 3.1 | 14 | $5.1 \times 10^5$ | $1.2 \times 10^6$ | 2.4 |
| Ex. 14 | 193 | 922 | 4.8 | 13 | $4.3 \times 10^5$ | $9.8 \times 10^5$ | 2.3 |
| Ex. 15 | 166 | 1302 | 7.9 | 16 | $5.1 \times 10^5$ | $1.4 \times 10^6$ | 2.7 |
| Ex. 16 | 203 | 532 | 2.6 | 11 | $5.8 \times 10^5$ | $9.7 \times 10^5$ | 1.7 |
| Ex. 17 | 198 | 726 | 3.7 | 13 | $4.2 \times 10^5$ | $9.8 \times 10^5$ | 2.3 |
| Ex. 18 | 198 | 805 | 4.1 | 14 | $2.9 \times 10^5$ | $6.8 \times 10^5$ | 2.3 |
| Ex. 19 | 187 | 845 | 4.5 | 12 | $5.9 \times 10^5$ | $9.8 \times 10^5$ | 1.7 |
| Ex. 20 | 183 | 699 | 3.8 | 12 | $5.1 \times 10^5$ | $8.5 \times 10^5$ | 1.7 |
| Ex. 21 | 177 | 723 | 4.1 | 11 | $5.3 \times 10^5$ | $8.4 \times 10^5$ | 1.6 |
| Ex. 22 | 190 | 677 | 3.6 | 13 | $5.0 \times 10^5$ | $9.2 \times 10^5$ | 1.8 |
| Ex. 23 | 165 | 699 | 4.2 | 13 | $1.3 \times 10^6$ | $3.2 \times 10^5$ | 2.5 |
| Ex. 24 | 204 | 835 | 4.1 | 15 | $8.1 \times 10^4$ | $2.3 \times 10^5$ | 2.8 |
| Ex. 25 | 177 | 835 | 4.7 | 14 | $1.0 \times 10^6$ | $3.5 \times 10^5$ | 3.5 |
| Ex. 26 | 171 | 835 | 4.9 | 12 | $1.5 \times 10^6$ | $4.2 \times 10^5$ | 2.8 |
| Ex. 27 | 166 | 835 | 5.0 | 13 | $5.8 \times 10^5$ | $9.8 \times 10^5$ | 1.7 |
| Ex. 28 | 164 | 934 | 5.7 | 15 | $4.8 \times 10^5$ | $9.8 \times 10^5$ | 2.0 |
| Ex. 29 | 152 | 1180 | 7.8 | 14 | $5.9 \times 10^4$ | $9.8 \times 10^4$ | 1.7 |
| Ex. 30 | 149 | 1372 | 9.2 | 17 | $1.3 \times 10^6$ | $3.4 \times 10^6$ | 2.6 |
| Ex. 31 | 158 | 868 | 5.5 | 15 | $2.3 \times 10^5$ | $5.6 \times 10^5$ | 2.4 |
| Ex. 32 | 150 | 970 | 6.5 | 17 | $9.5 \times 10^4$ | $3.0 \times 10^5$ | 3.2 |
| Ex. 33 | 141 | 1372 | 9.7 | 16 | $1.1 \times 10^5$ | $4.6 \times 10^5$ | 4.2 |
| Ex. 34 | 157 | 1305 | 8.3 | 16 | $6.1 \times 10^5$ | $2.0 \times 10^6$ | 3.3 |
| Ex. 35 | 208 | 512 | 2.5 | 15 | $8.3 \times 10^5$ | $2.1 \times 10^6$ | 2.5 |
| Ex. 36 | 216 | 595 | 2.8 | 16 | $1.1 \times 10^5$ | $6.5 \times 10^6$ | 5.9 |
| Ex. 37 | 163 | 665 | 4.1 | 15 | $1.3 \times 10^5$ | $8.7 \times 10^5$ | 6.7 |
| Ex. 38 | 288 | 862 | 3.0 | 15 | $5.4 \times 10^5$ | $3.0 \times 10^6$ | 5.6 |
| Ex. 39 | 441 | 1113 | 2.5 | 18 | $1.0 \times 10^6$ | $6.0 \times 10^6$ | 6.0 |
| Ex. 40 | 235 | 582 | 2.5 | 19 | $2.0 \times 10^5$ | $1.0 \times 10^6$ | 5.0 |
| Ex. 41 | 503 | 1219 | 2.4 | 16 | $8.6 \times 10^5$ | $2.0 \times 10^6$ | 2.3 |
| Ex. 42 | 131 | 1115 | 8.5 | 18 | $1.5 \times 10^6$ | $5.2 \times 10^6$ | 3.5 |
| Ex. 43 | 389 | 1033 | 2.7 | 19 | $8.7 \times 10^6$ | $6.0 \times 10^6$ | 6.9 |
| Ex. 44 | 171 | 473 | 2.8 | 18 | $1.0 \times 10^6$ | $6.0 \times 10^6$ | 6.0 |
| Cp. 1 | 270 | 562 | 2.1 | 28 | $1.0 \times 10^5$ | $8.9 \times 10^5$ | 8.9 |
| Cp. 2 | 194 | 299 | 1.5 | 35 | $9.0 \times 10^5$ | $8.6 \times 10^6$ | 10 |
| Cp. 3 | 239 | 349 | 1.5 | 35 | $8.6 \times 10^5$ | $8.1 \times 10^6$ | 9.4 |
| Cp. 4 | 224 | 445 | 2.0 | 28 | $7.1 \times 10^5$ | $6.8 \times 10^6$ | 10 |
| Cp. 5 | 352 | 672 | 1.9 | 30 | $2.0 \times 10^5$ | $1.3 \times 10^6$ | 10 |
| Cp. 6 | 186 | 258 | 1.4 | 34 | $1.5 \times 10^5$ | $2.9 \times 10^6$ | 29 |
| Cp. 7 | 415 | 577 | 1.4 | 34 | $2.0 \times 10^5$ | $3.4 \times 10^6$ | 17 |

TABLE 14

| | Environment 1 Halftone image No. | | | | | | | | Environment 2 Halftone image No. | | | | | | | | Environment 3 Halftone image No. | | | | | | | |
|---|---|---|---|---|---|---|---|---|---|---|---|---|---|---|---|---|---|---|---|---|---|---|---|---|
| | 1 | | 2 | | 3 | | 4 | | 1 | | 2 | | 3 | | 4 | | 1 | | 2 | | 3 | | 4 | |
| | Evaluation | | | | | | | | Evaluation | | | | | | | | Evaluation | | | | | | | |
| Ex. | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 3 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 4 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 5 | 1 | 2 | 2 | 2 | 3 | 2 | 3 | 3 | 1 | 1 | 1 | 2 | 2 | 2 | 3 | 3 | 2 | 2 | 2 | 3 | 3 | 3 | 3 | 3 |
| 6 | 1 | 1 | 1 | 1 | 1 | 1 | 2 | 2 | 1 | 1 | 1 | 1 | 1 | 1 | 1 | 2 | 1 | 1 | 1 | 1 | 1 | 1 | 2 | 2 |
| 7 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 8 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 9 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 10 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 11 | 1 | 1 | 1 | 1 | 1 | 1 | 1 | 1 | 1 | 1 | 1 | 1 | 1 | 1 | 1 | 1 | 1 | 1 | 1 | 1 | 1 | 2 | 1 | 1 |
| 12 | 1 | 1 | 1 | 1 | 1 | 2 | 2 | 2 | 1 | 1 | 1 | 1 | 1 | 1 | 1 | 2 | 1 | 1 | 1 | 1 | 1 | 2 | 2 | 2 |

TABLE 14-continued

| | Environment 1 Halftone image No. | | | | | | | | Environment 2 Halftone image No. | | | | | | | | Environment 3 Halftone image No. | | | | | | | |
|---|---|---|---|---|---|---|---|---|---|---|---|---|---|---|---|---|---|---|---|---|---|---|---|---|
| | 1 | | 2 | | 3 | | 4 | | 1 | | 2 | | 3 | | 4 | | 1 | | 2 | | 3 | | 4 | |
| | Evaluation | | | | | | | | Evaluation | | | | | | | | Evaluation | | | | | | | |
| Ex. | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 13 | 1 | 1 | 1 | 1 | 2 | 2 | 2 | 2 | 1 | 1 | 1 | 1 | 1 | 2 | 2 | 2 | 1 | 1 | 1 | 1 | 2 | 2 | 2 | 2 |
| 14 | 1 | 1 | 2 | 1 | 2 | 2 | 2 | 2 | 1 | 1 | 2 | 1 | 2 | 2 | 2 | 2 | 1 | 1 | 1 | 2 | 2 | 3 | 2 | 2 |
| 15 | 1 | 1 | 2 | 1 | 2 | 2 | 3 | 3 | 1 | 1 | 2 | 1 | 2 | 2 | 2 | 3 | 1 | 1 | 1 | 2 | 2 | 2 | 3 | 3 |
| 16 | 1 | 1 | 1 | 1 | 1 | 2 | 2 | 2 | 1 | 1 | 1 | 1 | 1 | 1 | 1 | 2 | 1 | 1 | 1 | 1 | 1 | 2 | 2 | 2 |
| 17 | 1 | 1 | 2 | 1 | 2 | 2 | 2 | 2 | 1 | 1 | 1 | 1 | 2 | 1 | 1 | 2 | 1 | 1 | 2 | 1 | 2 | 2 | 2 | 2 |
| 18 | 1 | 1 | 2 | 1 | 2 | 2 | 2 | 2 | 1 | 1 | 1 | 1 | 2 | 1 | 1 | 2 | 1 | 1 | 2 | 2 | 2 | 2 | 2 | 2 |
| 19 | 1 | 1 | 2 | 1 | 2 | 1 | 2 | 2 | 1 | 1 | 1 | 1 | 2 | 1 | 1 | 2 | 1 | 1 | 2 | 1 | 2 | 2 | 2 | 2 |
| 20 | 1 | 1 | 2 | 1 | 2 | 2 | 2 | 2 | 1 | 1 | 1 | 1 | 2 | 2 | 1 | 2 | 2 | 1 | 2 | 2 | 2 | 2 | 2 | 2 |
| 21 | 1 | 1 | 2 | 1 | 2 | 1 | 2 | 2 | 1 | 1 | 1 | 1 | 2 | 2 | 1 | 2 | 1 | 1 | 2 | 2 | 2 | 2 | 2 | 2 |
| 22 | 2 | 1 | 2 | 1 | 2 | 1 | 2 | 2 | 1 | 1 | 2 | 1 | 2 | 2 | 1 | 2 | 2 | 1 | 2 | 2 | 2 | 2 | 2 | 2 |
| 23 | 2 | 1 | 2 | 1 | 2 | 1 | 2 | 2 | 1 | 1 | 2 | 1 | 2 | 2 | 1 | 2 | 2 | 1 | 2 | 2 | 2 | 2 | 2 | 2 |
| 24 | 2 | 1 | 2 | 1 | 2 | 1 | 2 | 2 | 1 | 1 | 2 | 1 | 2 | 2 | 1 | 2 | 2 | 1 | 2 | 1 | 2 | 2 | 2 | 2 |
| 25 | 2 | 1 | 2 | 1 | 2 | 2 | 2 | 2 | 1 | 1 | 2 | 2 | 2 | 2 | 1 | 2 | 2 | 1 | 2 | 2 | 2 | 2 | 2 | 2 |
| 26 | 2 | 2 | 2 | 2 | 2 | 2 | 2 | 2 | 1 | 1 | 2 | 2 | 2 | 2 | 2 | 2 | 1 | 2 | 2 | 2 | 2 | 2 | 2 | 2 |
| 27 | 2 | 1 | 2 | 2 | 2 | 2 | 2 | 2 | 1 | 2 | 2 | 2 | 2 | 2 | 2 | 2 | 1 | 2 | 2 | 2 | 2 | 2 | 2 | 2 |
| 28 | 2 | 1 | 2 | 2 | 2 | 2 | 2 | 2 | 1 | 2 | 2 | 2 | 2 | 2 | 2 | 2 | 1 | 2 | 2 | 2 | 2 | 2 | 2 | 2 |
| 29 | 2 | 1 | 2 | 2 | 2 | 2 | 2 | 2 | 1 | 2 | 2 | 2 | 2 | 2 | 2 | 2 | 1 | 2 | 2 | 2 | 2 | 2 | 2 | 2 |
| 30 | 2 | 1 | 2 | 3 | 3 | 3 | 3 | 3 | 2 | 2 | 3 | 2 | 3 | 3 | 3 | 3 | 1 | 2 | 3 | 2 | 3 | 3 | 3 | 3 |
| 31 | 1 | 1 | 1 | 1 | 1 | 2 | 2 | 2 | 1 | 1 | 1 | 1 | 1 | 1 | 1 | 2 | 1 | 1 | 1 | 1 | 1 | 2 | 2 | 2 |
| 32 | 1 | 1 | 1 | 1 | 2 | 2 | 2 | 2 | 1 | 1 | 1 | 1 | 1 | 1 | 1 | 2 | 1 | 1 | 1 | 1 | 2 | 2 | 2 | 2 |
| 33 | 3 | 2 | 3 | 3 | 3 | 3 | 3 | 3 | 2 | 2 | 3 | 2 | 3 | 3 | 3 | 3 | 3 | 2 | 3 | 3 | 3 | 3 | 3 | 3 |
| 34 | 2 | 2 | 2 | 3 | 3 | 3 | 3 | 3 | 2 | 2 | 3 | 2 | 3 | 3 | 3 | 3 | 2 | 2 | 3 | 3 | 3 | 3 | 3 | 3 |
| 35 | 3 | 2 | 3 | 2 | 3 | 3 | 3 | 3 | 3 | 2 | 3 | 2 | 3 | 3 | 3 | 3 | 3 | 2 | 3 | 3 | 3 | 3 | 3 | 3 |
| 36 | 2 | 2 | 3 | 2 | 3 | 3 | 3 | 3 | 2 | 2 | 2 | 2 | 3 | 3 | 3 | 3 | 2 | 2 | 2 | 2 | 2 | 3 | 3 | 3 |
| 37 | 2 | 2 | 2 | 2 | 3 | 2 | 3 | 3 | 2 | 2 | 2 | 2 | 2 | 2 | 3 | 3 | 2 | 2 | 2 | 2 | 2 | 2 | 3 | 3 |
| 38 | 2 | 2 | 2 | 2 | 3 | 2 | 3 | 3 | 2 | 2 | 2 | 2 | 3 | 2 | 3 | 3 | 2 | 2 | 2 | 2 | 3 | 2 | 3 | 3 |
| 39 | 2 | 2 | 2 | 2 | 3 | 2 | 3 | 3 | 2 | 2 | 2 | 2 | 3 | 2 | 3 | 3 | 2 | 2 | 2 | 2 | 3 | 3 | 3 | 3 |
| 40 | 2 | 2 | 3 | 2 | 3 | 3 | 3 | 3 | 2 | 2 | 2 | 2 | 3 | 3 | 3 | 3 | 2 | 2 | 3 | 2 | 3 | 3 | 3 | 3 |
| 41 | 3 | 2 | 3 | 3 | 3 | 3 | 3 | 3 | 2 | 2 | 3 | 3 | 3 | 3 | 3 | 3 | 3 | 2 | 3 | 3 | 3 | 3 | 3 | 3 |
| 42 | 2 | 2 | 3 | 3 | 3 | 3 | 3 | 3 | 2 | 2 | 3 | 2 | 3 | 3 | 3 | 3 | 2 | 2 | 3 | 2 | 3 | 3 | 3 | 3 |
| 43 | 2 | 2 | 3 | 3 | 3 | 3 | 3 | 3 | 2 | 2 | 3 | 3 | 3 | 3 | 3 | 3 | 2 | 2 | 3 | 3 | 3 | 3 | 3 | 3 |
| 44 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |

Ex.: Example

TABLE 15

| | Environment 1 Halftone image No. | | | | | | | | Environment 2 Halftone image No. | | | | | | | | Environment 3 Halftone image No. | | | | | | | |
|---|---|---|---|---|---|---|---|---|---|---|---|---|---|---|---|---|---|---|---|---|---|---|---|---|
| | 1 | | 2 | | 3 | | 4 | | 1 | | 2 | | 3 | | 4 | | 1 | | 2 | | 3 | | 4 | |
| | Evaluation | | | | | | | | Evaluation | | | | | | | | Evaluation | | | | | | | |
| Cp. | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| 1 | 3 | 2 | 3 | 3 | 3 | 3 | 4 | 4 | 2 | 2 | 3 | 3 | 3 | 3 | 4 | 4 | 3 | 2 | 3 | 3 | 3 | 3 | 4 | 4 |
| 2 | 3 | 3 | 4 | 4 | 4 | 4 | 4 | 4 | 3 | 3 | 4 | 4 | 4 | 4 | 4 | 4 | 3 | 3 | 4 | 4 | 4 | 4 | 4 | 4 |
| 3 | 3 | 3 | 4 | 4 | 4 | 4 | 4 | 4 | 3 | 3 | 4 | 4 | 4 | 4 | 4 | 4 | 3 | 3 | 4 | 4 | 4 | 4 | 4 | 4 |
| 4 | 3 | 3 | 3 | 3 | 4 | 4 | 4 | 4 | 3 | 3 | 3 | 3 | 4 | 4 | 4 | 4 | 3 | 3 | 3 | 3 | 4 | 4 | 4 | 4 |
| 5 | 3 | 3 | 3 | 3 | 4 | 4 | 4 | 4 | 3 | 3 | 3 | 3 | 4 | 4 | 4 | 4 | 3 | 3 | 3 | 3 | 4 | 4 | 4 | 4 |
| 6 | 4 | 3 | 4 | 4 | 4 | 4 | 4 | 4 | 4 | 3 | 4 | 4 | 4 | 4 | 4 | 4 | 4 | 3 | 4 | 4 | 4 | 4 | 4 | 4 |
| 7 | 3 | 3 | 4 | 4 | 4 | 4 | 4 | 4 | 3 | 3 | 4 | 4 | 4 | 4 | 4 | 4 | 3 | 3 | 4 | 4 | 4 | 4 | 4 | 4 |

Cp.: Comparative Example

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2011-051938, filed on Mar. 9, 2011, which is herein incorporated by reference as part of this application.

What is claimed is:

1. A charging member which comprises an electrically conductive substrate, an electrically conductive elastic layer and a surface layer, wherein;

the elastic layer has, in the order from the substrate side, a first rubber layer and a second rubber layer laminated to the first rubber layer, and, where the natural vibration frequency of the first rubber layer is represented by $f_1$, and the natural vibration frequency of the second rubber layer is represented by $f_2$, the elastic layer has a natural vibration frequency ratio, $f_2/f_1$, of from 2.35 or more to 10.0 or less.

2. The charging member according to claim 1, wherein the $f_2$ is from 400 Hz or more to 1,400 Hz or less.

3. The charging member according to claim 1, wherein the first rubber layer and the second rubber layer each contain a filler.

4. The charging member according to claim 3, wherein;

the first rubber layer contains one or two or more fillers selected from the group consisting of calcium carbonate, magnesium carbonate, zinc oxide, tin oxide and magnesium oxide; and the second rubber layer contains one or both fillers selected from carbon black and silica.

5. The charging member according to claim 3, wherein;

the filler in the second rubber layer has a volume-average particle diameter which is smaller than that of the filler in the first rubber layer.

6. The charging member according to claim 1, wherein;

the first rubber layer contains one or two or more rubbers selected from the group consisting of epichlorohydrin rubber, urethane rubber and fluorine rubber; and the second rubber layer contains one or two or more rubbers selected from the group consisting of acrylonitrile-butadiene rubber, styrene-butadiene rubber, ethylene-propylene rubber and butadiene rubber.

7. A process cartridge which comprises the charging member according to claim 1, and a photosensitive member which are integrally joined, and is so set up as to be detachably mountable to the main body of an electrophotographic apparatus.

8. An electrophotographic apparatus which comprises the charging member according to claim 1, and a photosensitive member.

9. The electrophotographic apparatus according to claim 8, which has a means for applying an alternating-current voltage to the charging member.

* * * * *